US011343620B2

(12) United States Patent
Elmedyb et al.

(10) Patent No.: US 11,343,620 B2
(45) Date of Patent: May 24, 2022

(54) METHOD OF OPERATING A HEARING AID SYSTEM AND A HEARING AID SYSTEM

(71) Applicant: Widex A/S, Lynge (DK)

(72) Inventors: Thomas Bo Elmedyb, Herlev (DK); Lars Dalskov Mosgaard, Copenhagen (DK); Michael Johannes Pihl, Copenhagen (DK); Georg Stiefenhofer, Hundested (DK); Jakob Nielsen, Copenhagen (DK); Adam Westermann, Copenhagen (DK)

(73) Assignee: Widex A/S, Lynge (DK)

( * ) Notice: Subject to any disclaimer, the term of this patent is extended or adjusted under 35 U.S.C. 154(b) by 0 days.

(21) Appl. No.: 16/955,512

(22) PCT Filed: Dec. 21, 2018

(86) PCT No.: PCT/EP2018/086470
§ 371 (c)(1),
(2) Date: Jun. 18, 2020

(87) PCT Pub. No.: WO2019/122284
PCT Pub. Date: Jun. 27, 2019

(65) Prior Publication Data

US 2020/0322738 A1 Oct. 8, 2020

(30) Foreign Application Priority Data

Dec. 21, 2017 (DK) ..... PA201700736

(51) Int. Cl.
*H04R 25/00* (2006.01)

(52) U.S. Cl.
CPC ..... *H04R 25/505* (2013.01); *H04R 25/552* (2013.01)

(58) Field of Classification Search
None
See application file for complete search history.

(56) References Cited

U.S. PATENT DOCUMENTS

| | | | | |
|---|---|---|---|---|
| 5,325,436 | A | 6/1994 | Soli et al. | |
| 5,721,783 | A | 2/1998 | Anderson | |
| 5,892,836 | A | 4/1999 | Ishige et al. | |
| 2004/0037442 | A1* | 2/2004 | Nielsen | H04R 25/554 381/315 |
| 2009/0017784 | A1 | 1/2009 | Dickson et al. | |
| 2011/0194713 | A1 | 8/2011 | Apfel et al. | |
| 2012/0008791 | A1 | 1/2012 | Gerkmann et al. | |
| 2013/0089228 | A1 | 4/2013 | Strelcyk | |

FOREIGN PATENT DOCUMENTS

WO 2018/141464 A1 8/2018

OTHER PUBLICATIONS

International Search Report for PCT/EP2018/086470 dated Mar. 14, 2019 (PCT/ISA/210).
Written Opinion of the International Searching Authority for PCT/EP2018/086470 dated Mar. 14, 2019 (PCT/ISA/237).
Danish Search Report for PA201700736 dated Feb. 16, 2018.

* cited by examiner

*Primary Examiner* — Kenny H Truong
(74) *Attorney, Agent, or Firm* — Sughrue Mion, PLLC

(57) ABSTRACT

A method of operating a hearing aid having a main digital filter adapted to selectively represent a specific combination of serial and parallel coupled virtual digital filters as well as a hearing aid and a hearing aid system adapted to carry out the method.

13 Claims, 10 Drawing Sheets

METHOD OF OPERATING A HEARING AID SYSTEM AND A HEARING AID SYSTEM

CROSS REFERENCE TO RELATED APPLICATIONS

This application is a National Stage of International Application No. PCT/EP2018/086470 filed Dec. 21, 2018, claiming priority based on Danish Patent Application No. PA201700736, filed Dec. 21, 2017.

The present invention relates to a method of operating a hearing aid system. The present invention also relates to a hearing aid system adapted to carry out said method.

BACKGROUND OF THE INVENTION

Generally a hearing aid system according to the invention is understood as meaning any device which provides an output signal that can be perceived as an acoustic signal by a user or contributes to providing such an output signal, and which has means which are customized to compensate for an individual hearing loss of the user or contribute to compensating for the hearing loss of the user. They are, in particular, hearing aids which can be worn on the body or by the ear, in particular on or in the ear, and which can be fully or partially implanted. However, some devices whose main aim is not to compensate for a hearing loss, may also be regarded as hearing aid systems, for example consumer electronic devices (televisions, hi-fi systems, mobile phones, MP3 players etc.) provided they have, however, measures for compensating for an individual hearing loss.

Within the present context a traditional hearing aid can be understood as a small, battery-powered, microelectronic device designed to be worn behind or in the human ear by a hearing-impaired user. Prior to use, the hearing aid is adjusted by a hearing aid fitter according to a prescription. The prescription is based on a hearing test, resulting in a so-called audiogram, of the performance of the hearing-impaired user's unaided hearing. The prescription is developed to reach a setting where the hearing aid will alleviate a hearing loss by amplifying sound at frequencies in those parts of the audible frequency range where the user suffers a hearing deficit. A hearing aid comprises one or more microphones, a battery, a microelectronic circuit comprising a signal processor, and an acoustic output transducer. The signal processor is preferably a digital signal processor. The hearing aid is enclosed in a casing suitable for fitting behind or in a human ear.

Within the present context a hearing aid system may comprise a single hearing aid (a so called monaural hearing aid system) or comprise two hearing aids, one for each ear of the hearing aid user (a so called binaural hearing aid system). Furthermore, the hearing aid system may comprise an external device, such as a smart phone having software applications adapted to interact with other devices of the hearing aid system. Thus within the present context the term "hearing aid system device" may denote a hearing aid or an external device.

The mechanical design has developed into a number of general categories. As the name suggests, Behind-The-Ear (BTE) hearing aids are worn behind the ear. To be more precise, an electronics unit comprising a housing containing the major electronics parts thereof is worn behind the ear. An earpiece for emitting sound to the hearing aid user is worn in the ear, e.g. in the concha or the ear canal. In a traditional BTE hearing aid, a sound tube is used to convey sound from the output transducer, which in hearing aid terminology is normally referred to as the receiver, located in the housing of the electronics unit and to the ear canal. In some modern types of hearing aids, a conducting member comprising electrical conductors conveys an electric signal from the housing and to a receiver placed in the earpiece in the ear. Such hearing aids are commonly referred to as Receiver-In-The-Ear (RITE) hearing aids. In a specific type of RITE hearing aids the receiver is placed inside the ear canal. This category is sometimes referred to as Receiver-In-Canal (RIC) hearing aids.

In-The-Ear (ITE) hearing aids are designed for arrangement in the ear, normally in the funnel-shaped outer part of the ear canal. In a specific type of ITE hearing aids the hearing aid is placed substantially inside the ear canal. This category is sometimes referred to as Completely-In-Canal (CIC) hearing aids. This type of hearing aid requires an especially compact design in order to allow it to be arranged in the ear canal, while accommodating the components necessary for operation of the hearing aid.

Hearing loss of a hearing impaired person is quite often frequency-dependent. This means that the hearing loss of the person varies depending on the frequency. Therefore, when compensating for hearing losses, it can be advantageous to utilize frequency-dependent amplification. Hearing aids therefore often provide to split an input sound signal received by an input transducer of the hearing aid, into various frequency intervals, also called frequency bands, which are independently processed. In this way, it is possible to adjust the input sound signal of each frequency band individually to account for the hearing loss in respective frequency bands. The frequency dependent adjustment is normally done by implementing a band split filter and compressors for each of the frequency bands, so-called band split compressors, which may be summarised to a multi-band compressor. In this way, it is possible to adjust the gain individually in each frequency band depending on the hearing loss as well as the input level of the input sound signal in a specific frequency range. For example, a band split compressor may provide a higher gain for a soft sound than for a loud sound in its frequency band.

The filter banks used in such multi-band compressors are well known within the art of hearing aids, but are nevertheless based on a number of tradeoffs. Most of these tradeoffs deal with the frequency resolution as will be further described below.

There are some very clear advantages of having a high resolution filter bank. The higher the frequency resolution, the better individual periodic components can be distinguished from each other. This gives a much finer signal analysis and enables more advanced signal processing. Especially noise reduction and speech enhancement schemes may benefit from a higher frequency resolution.

However, a filter bank with a high frequency resolution generally introduces a correspondingly long delay, which for most people will have a detrimental effect on the perceived sound quality.

It has therefore been suggested to reduce the delay incurred by filter banks, such as Discrete Fourier Transform (DFT) and Finite Impulse Response (FIR) filter banks by: applying a time-varying filter with a response that corresponds to the desired frequency dependent gains that were otherwise to be applied to the frequency bands provided by the filter banks. However, this solution still requires that the frequency dependent gains are calculated in an analysis part of the system, and in case the analysis part comprises filter banks, then the determined frequency dependent gains will be delayed relative to the signal that the gains are to be applied to using the time-varying filter. Furthermore, the time-varying filter in itself will inherently introduce a delay although this delay is generally significantly shorter than the delay introduced by the filter banks. It has furthermore been suggested in the art to minimize the delay introduced by the time-varying filter by implementing the time-varying filter as minimum-phase. However, this solution only reduces the delay of the time-varying filter, without paying attention to the delay that may be introduced by other components in the hearing aid.

Furthermore it may be difficult to implement, in a hearing aid, the filter synthetization methods required for realizing hearing aid signal processing solutions, including digital time-varying filters, due to the limited processing resources in contemporary hearing aid.

U.S. Pat. No. 5,721,783, by Anderson discloses a system with an earpiece and an external device, wherein sounds from the environment are picked up by a microphone in the earpiece and sent with other information over a two-way wireless link to the external device, where the audio signals are enhanced according to the user's needs before transmission over the wireless link to the earpiece. Signal processing is performed in the external device rather than the earpiece to take advantage of relaxed size and power constraints.

However, contemporary hearing aid systems are still limited with respect to the offered flexibility for various signal processing approaches.

It is therefore a feature of the present invention to provide a method of operating a hearing aid system that provides signal processing with improved flexibility.

It is another feature of the present invention to provide a hearing aid and a hearing aid system adapted to provide such a method of operating a hearing aid system.

SUMMARY OF THE INVENTION

The invention, in a first aspect, provides a hearing aid according to claim 1.

This provides a hearing aid with improved signal processing flexibility.

The invention, in a second aspect, provides a hearing aid system according to claim 10.

This provides a hearing aid system with improved signal processing flexibility.

The invention, in a third aspect, provides a method of operating a hearing aid system according to claim 12.

This provides an improved method of operating a hearing aid system.

Further advantageous features appear from the dependent claims.

Still other features of the present invention will become apparent to those skilled in the art from the following description wherein the invention will be explained in greater detail.

BRIEF DESCRIPTION OF THE DRAWINGS

By way of example, there is shown and described a preferred embodiment of this invention. As will be realized, the invention is capable of other embodiments, and its several details are capable of modification in various, obvious aspects all without departing from the invention. Accordingly, the drawings and descriptions will be regarded as illustrative in nature and not as restrictive. In the drawings.

DETAILED DESCRIPTION

Figure 1:
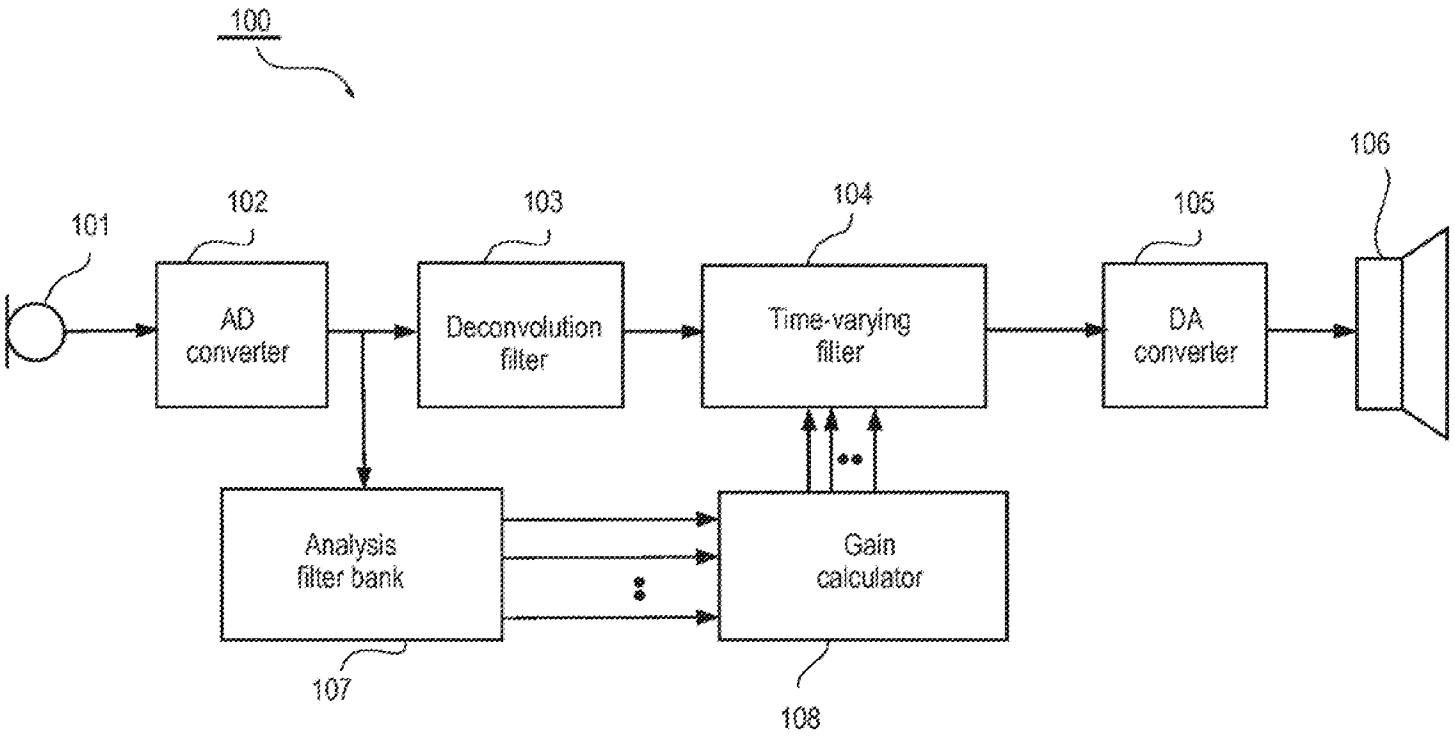
FIG. 1 illustrates highly schematically a hearing aid according to an embodiment of the invention.

In the present context the terms "amplitude response", "frequency dependent amplitude response" and "frequency dependent gain" are used interchangeably.

Furthermore it is noted that the terms "frequency response" or "complex frequency response" may likewise be used interchangeably and represent are more general term that as a special case may represent the "amplitude" and "gain" terms given above.

The hearing aid 100 comprises an acoustical-electrical input transducer 101, i.e. a microphone, an analog-digital converter (ADC) 102, a deconvolution filter 103, a time-varying filter 104, a digital-analog converter (DAC) 105, an electro-acoustical output transducer, i.e. the hearing aid speaker 106, an analysis filter bank 107 and a gain calculator 108.

According to the embodiment of FIG. 1, the microphone 101 provides an analog input signal that is converted into a digital input signal by the analog-digital converter 102. However, in the following, the term digital input signal may be used interchangeably with the term input signal and the same is true for all other signals referred to in that they may or may not be specifically denoted as digital signals.

The digital input signal is branched, whereby the input signal, in a first branch, is provided to the deconvolution filter 103 and, in a second branch, provided to the analysis filter bank 107. The digital input signal, in the first branch, is hereby filtered by the deconvolution filter 103 and subsequently by the time-varying filter 104. The output from the time-varying filter is a digital signal that is processed to alleviate an individual hearing deficiency of a hearing aid user. This processed digital signal is subsequently provided to the digital-analog converter 105 and further on to the acoustical-electrical output transducer 106 for conversion of the signal into sound.

The digital input signal, in the second branch, is split into a multitude of frequency band signals by the analysis filter bank 107 and provided to the gain calculator 108 that derives a frequency dependent target gain, adapted for alleviating an individual hearing deficiency of a hearing aid user, and based hereon derives corresponding filter coefficients for the time-varying filter 104.

According to an embodiment, the frequency dependent and time-varying target gain is adapted to improve speech intelligibility or reduce noise or both in addition to being adapted to alleviating an individual hearing deficit. In further variations the time varying target gain is not adapted to alleviating an individual hearing deficit and instead directed only at reducing noise.

According to an embodiment the digital input signal is branched after processing in the deconvolution filter 103 as opposed to being branched before, and in a further variation the branching may be implemented somewhere between the time-varying filter 104 and the digital analog converter 105.

According to an embodiment, the analysis filter bank 107 is implemented in the time-domain and in another embodiment, the analysis filter bank is implemented in the frequency domain using e.g. Discrete Fourier Transformation.

According to an embodiment the digital-analog converter 105 is implemented as a sigma-delta converter, e.g. as disclosed in EP-B1-793897. However, in the following the terminology digital-analog converter is used independent of the chosen implementation.

The deconvolution filter 103 is a filter that is designed to deconvolute at least a part of the unavoidable convolution of the input signal from components such as the microphone 101, the ADC 102, the DAC 105 and the hearing aid speaker 106.

In the present context, these components may in the following be denoted static components as opposed to e.g. the time-varying filter 104 that obviously has a non-static transfer function.

According to an embodiment, the unavoidable convolution of the input signal from the static hearing aid components is determined based on obtaining the combined transfer function of the static hearing aid components. This may be done in a very simple manner by providing a test sound for the hearing aid and subsequently recording the corresponding sound provided by the hearing aid, while the time-varying filter is set to be transparent, and based hereof the combined transfer function can be derived from the ratio of the cross-correlation spectrum of the recorded sound and the test sound relative to the energy of the test sound. This may be done when manufacturing the hearing aid or as part of the initial hearing aid programming in which case the algorithms for determining the combined transfer function is implemented in the hearing aid programming software.

In the following, it will be assumed that the various transfer functions are determined in the z-domain and that the deconvolution filter 103 and the time-varying filter 104 subsequently are implemented in the time-domain. It is generally preferred to implement the filters in the time-domain in order to avoid the delay introduced by transforming the signal from the time domain and to the frequency domain and back again. However, in variations the deconvolution filter 103 and the time-varying filter 104 may be implemented in the frequency domain and in yet other variations other transformations than the z-domain may be used to determine the various transfer functions, but this is generally considered less attractive.

According to an embodiment, the determination of the combined transfer function of the static components may be carried out by software implemented in an external hearing aid system device, such as a so called app in a smart phone. Hereby, the determination may be carried out by the user with regular intervals, which may be advantageous because the combined transfer function may change due to e.g. ageing of the static components. According to another embodiment, the determination of the combined transfer function may be carried out while the hearing aid is positioned in a box that is also adapted for recharging a power source in the hearing aid.

It has been found that the combined transfer function may be represented by a stable pole-zero system that is not minimum phase, but can be decomposed into a minimum-phase system and an all-pass system that is not minimum phase.

A minimum-phase system is characterized in that it has a stable inverse, which means that all poles and zeros are within the unit circle, wherefrom it may be concluded that the inverse of a minimum-phase system is also minimum phase. Thus when decomposing the pole-zero system representing the combined transfer function, the resulting all-pass system will not be stable.

By designing the deconvolution filter 103 with a transfer function that is the inverse of the minimum-phase system of the combined transfer function of the hearing aid components it is possible to cancel out this minimum-phase system.

By cancelling the minimum phase system, the total delay in the hearing aid will be reduced which is advantageous in its own right and furthermore the cancelling will reduce frequency peaks in the combined amplitude response, which otherwise are an intrinsic part of most microphones and loudspeakers today.

Figure 2:
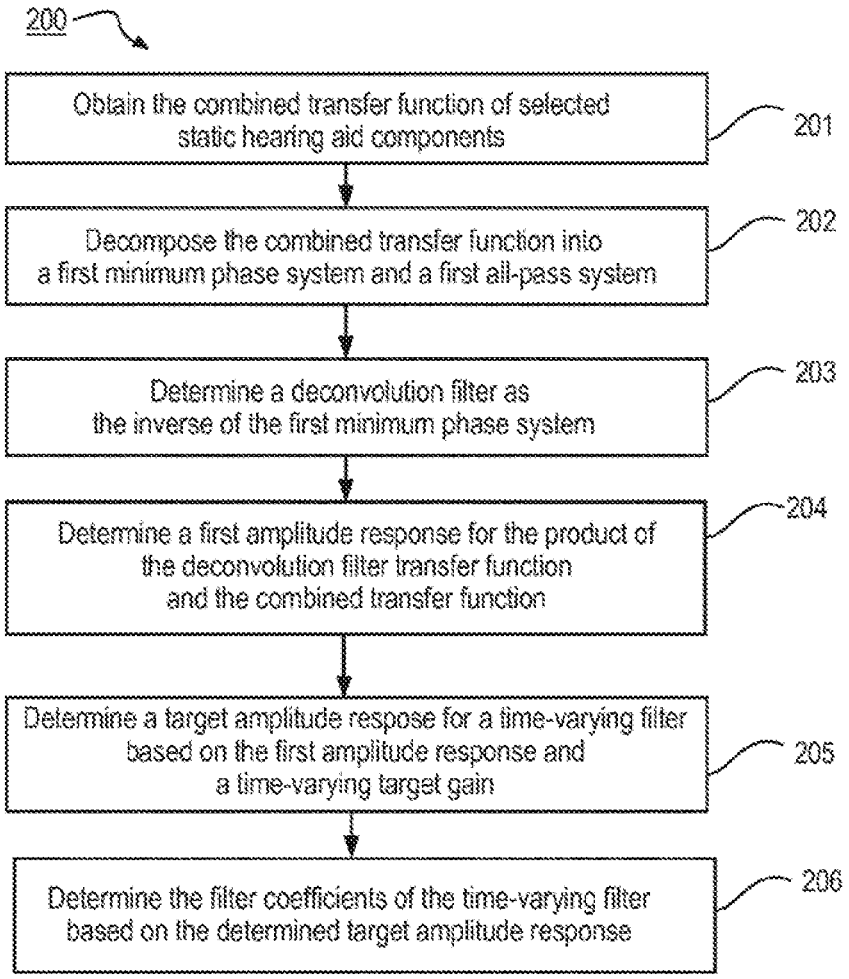
FIG. 2 illustrates highly schematically a method of operating a hearing aid according to an embodiment of the invention.

Reference is now made to FIG. 2, which illustrates highly schematically a method 200 of operating a hearing aid system according to an embodiment of the invention.

In a first step, 201, the combined transfer function of selected static hearing aid components is obtained.

In a second step, 202, the pole-zero system representing the obtained combined transfer function is decomposed into a first minimum phase system and a first all-pass system.

In a third step, 203, a deconvolution filter pole-zero system is determined as the inverse of the first minimum phase system and the filter coefficients for the deconvolution filter are derived.

In a fourth step, 204, a first amplitude response is determined, for the product of the deconvolution filter transfer function and the combined transfer function.

In a fifth step, 205, a target amplitude response for a time-varying filter is determined based on the first amplitude response and a time-varying target gain adapted to alleviate an individual hearing deficit.

In a sixth step, 206, the filter coefficients of the time-varying filter are derived based on the determined target amplitude response.

Hereby is provided a method of operating a hearing aid system with a very low time delay.

According to an embodiment, the derived filter coefficients for the deconvolution filter 103 and the time-varying filter 104 are optimized based on a cost function derived from perceptual criteria in order to achieve the best possible sound quality. In this way an optimum compromise between perceived sound quality and matching of the resulting amplitude response with the derived target amplitude response is achieved. In a variation of this embodiment, the optimum compromise is determined based on user interaction and in a further variation the user interaction is controlled by an interactive personalization scheme, wherein a user is prompted to select between different settings of the two filters and based on the user responses the interactive personalization scheme finds an optimized setting. Further details on one example of such an interactive personalization scheme may be found e.g. in WO-A1-2016004983.

A method of optimizing the filter coefficients based on user preference through an interactive personalization scheme is particularly attractive because it is difficult to predict in advance the cost function that best suits the individual users preferences. Therefore effective optimization may be achieved using an interactive personalization scheme.

According to an additional variation, the user interaction comprises optimizing a speech intelligibility measure as a function of the selected filter coefficients.

According to an embodiment the time-varying filter 104 is implemented as a minimum phase filter. Generally any target amplitude response may be implemented as a minimum phase filter if a filter of sufficiently high order is available. If this is not the case a minimum phase filter, based on the available filter order, may be achieved by accepting a less precise matching to target amplitude response, e.g. by smoothing the frequency dependent target amplitude response curve. However, according to an alternative embodiment the time-varying filter 104 is not implemented as a minimum phase filter. In further variations the time-varying filter 104 may be implemented as a FIR filter or as an Infinite Impulse Response (IIR) filter or generally any type of filter.

Figure 3:
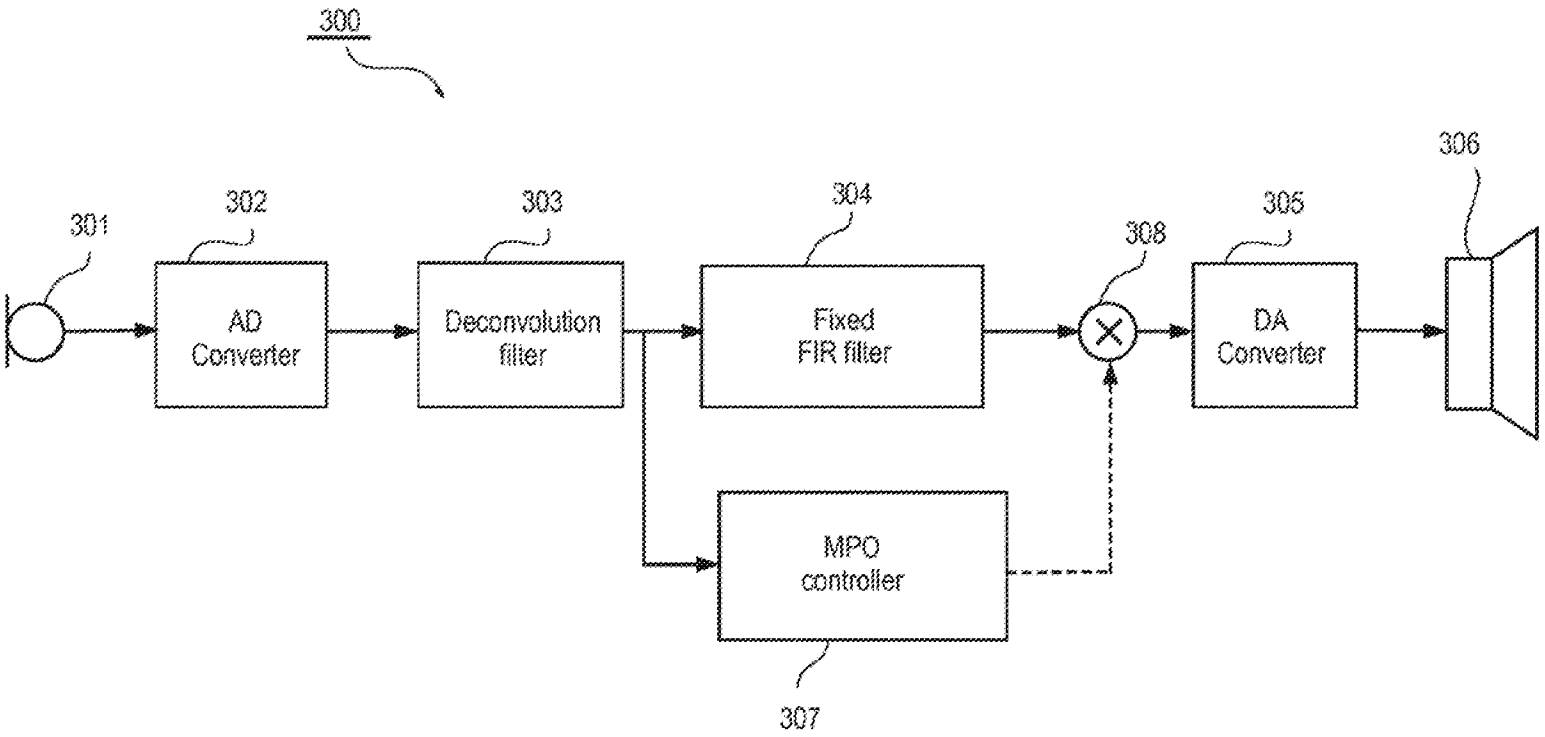
FIG. 3 illustrates highly schematically a hearing aid according to an embodiment of the invention.

Reference is now given to FIG. 3, which illustrates highly schematically a hearing aid system 300 according to an embodiment of the invention.

The hearing aid 300 comprises an acoustical-electrical input transducer 301, i.e. a microphone, an analog-digital converter (ADC) 302, a deconvolution filter 303, a fixed Finite Impulse Response (FIR) filter 304, a digital-analog converter (DAC) 305, an electro-acoustical output transducer, i.e. the hearing aid speaker 306, a Maximum Power Output (MPO) controller 307 and a gain multiplier 308.

According to the embodiment of FIG. 3 the microphone 301 provides an analog input signal that is converted into a digital input signal by the analog-digital converter 302. The digital input signal is provided to the deconvolution filter 303 and the resulting deconvoluted signal is branched, whereby the deconvoluted signal, in a first branch, is provided to the fixed FIR filter 304 that is adapted to compensate, or at least alleviate, an individual hearing deficiency of a hearing aid user and, in a second branch, is provided to the MPO controller 307 that estimates the power of the deconvoluted signal and based hereon calculates a negative gain to be applied to the fixed FIR filter output signal by the gain multiplier 308, in case this is required in order to avoid saturation of the digital-analog converter 305 or the hearing aid speaker 306 or that a too high sound pressure level is provided by the hearing aid speaker.

Thus the fixed FIR filter output signal is first provided to the gain multiplier 308 and subsequently provided to the digital-analog converter 305 and further on to the acoustical-electrical output transducer 306 for conversion of the signal into sound.

The deconvolution filter 303 according to this embodiment is adapted and operates as already described with reference to FIG. 1.

The hearing aid according to the embodiment of FIG. 3 is especially advantageous in that it provides a digital hearing aid with an extremely low delay and reasonable performance with respect to alleviating a hearing deficit of a hearing aid user. This is partly due to the fact that the hearing aid system 300 and its variations don't comprise any filter bank.

According to obvious variations the fixed FIR filter 304 may be implemented as e.g. an IIR filter or some other filter type.

Figure 4:
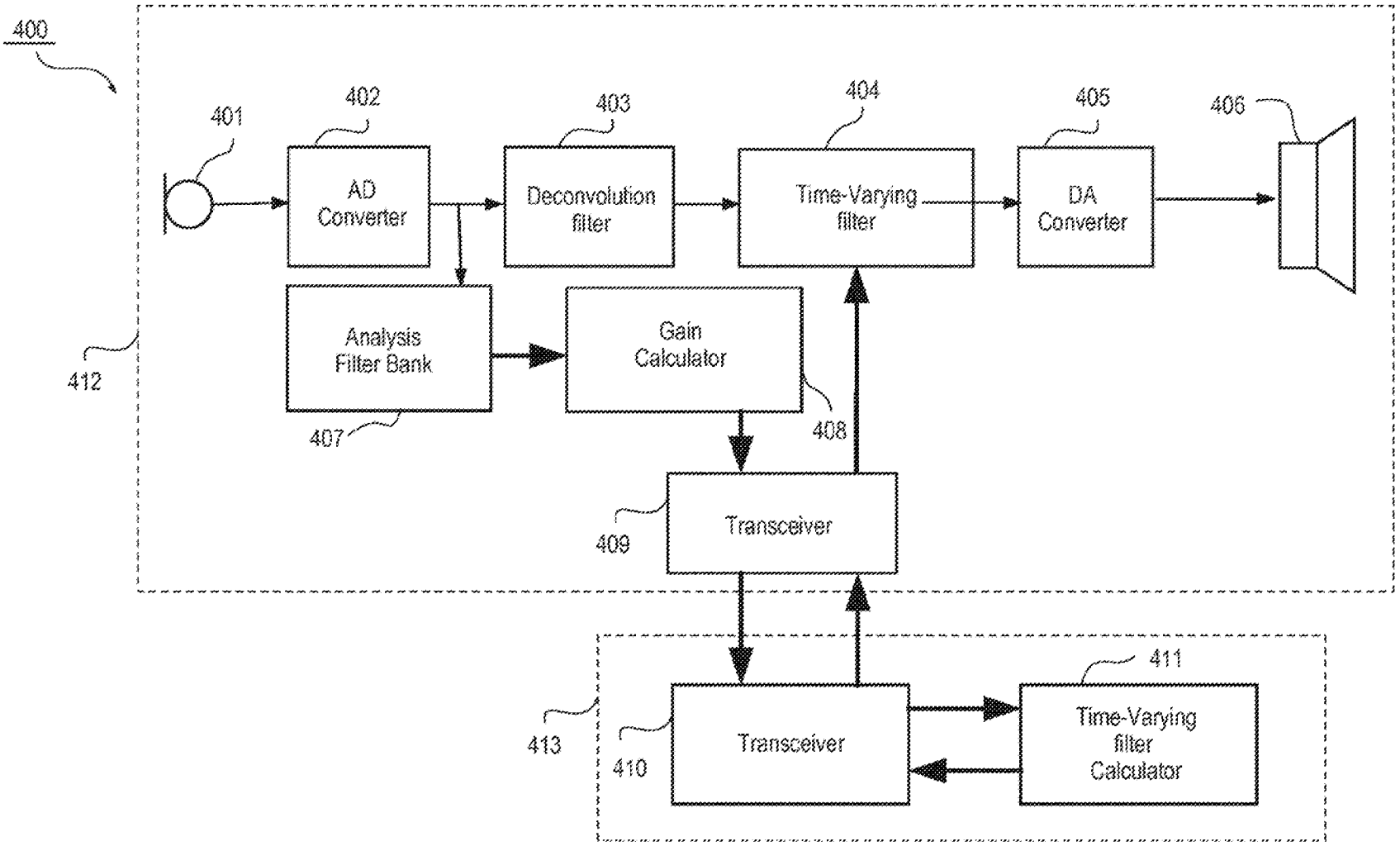
FIG. 4 illustrates highly schematically a hearing aid system according to an embodiment of the invention.

According to a variation the functionality of the MPO controller 307 is extended to work as a broadband hearing aid compressor, i.e. controlling sound pressure level of Reference is now made to FIG. 4, which illustrates highly schematically a hearing aid system 400 comprising a hearing aid 412 and an external device 413. The hearing aid 412 is similar to the hearing aid 100 according to the embodiment of FIG. 1 except in that the gain calculation required to control the time-varying filter 404 is distributed between the hearing aid 412 and the external device 413. In FIG. 4 some of the arrows are drawn in bold in order to illustrate a multitude of frequency band that are initially provided by the analysis filter bank 407. The gain calculator 408 is configured to provide a frequency dependent target amplitude response adapted to alleviate a hearing deficit of an individual hearing system user. The frequency dependent target amplitude response is provided to the hearing aid transceiver 409 that transmits, wired or wireless, the target amplitude response to the external device transceiver 410, wherefrom the target amplitude response is provided to the external device time-varying filter calculator 411, wherein corresponding filter coefficients are determined. Finally the determined filter coefficients are transmitted back to hearing aid 412, using the external device transceiver 410 and the hearing aid transceiver 409 and used to control the time-varying filter 404.

The FIG. 4 embodiment is especially advantageous because the partial distribution of the processing required to control the time-varying filter 404 allows use of the abundant processing resources available in most external devices, such as smart phones.

Additionally the embodiment is advantageous in that the hearing aid system delay is very low because only the analysis branch is affected by the delay introduced by the transmission back and forth between the hearing aid 412 and the external device 413—obviously the update of the of the time-varying filter will be delayed in response to the additional delay introduced in the analysis branch, but the inventors have found that to be of lesser importance.

The embodiment is furthermore advantageous in that very limited amounts of data need to be transmitted between the hearing aid 412 and the external device 413 because the frequency dependent target amplitude response is represented by a single gain value in a limited multitude of frequency bands, which according to the embodiment of FIG. 4 is 15, but in variations may be in the range between say 3 and 64, and because the determined filter coefficients correspondingly consists of a limited number of coefficients, which according to the embodiment of FIG. 4 is 64, but in variations may be in the range between 32 and 512 or more specifically in the range between 32 and 128.

In a variation the gain calculator 408 is accommodated in the external device 413 instead of in the hearing aid 412, which is particularly advantageous because it is expected that off-the-shelf digital signal processors for audio in the future will encompass the ability to provide the power spectrum or the frequency domain representation of the time domain input signal as a standard feature, while the calculation of the desired gain may not necessarily become a standard feature. In this variation the amount of data to be transmitted between the hearing aid 412 and the external device 413 may be somewhat larger, compared to the case where only data representing the frequency dependent target amplitude response are transmitted, in order to take advantage of the fact that off-the-shelf digital signal processors for audio in the near future are expected to provide a relatively high-resolution power spectrum i.e. a spectrum having say 512 channels (wherein channels may also be denoted frequency bins) or having between 32 and 4096 channels. As will be obvious for a person skilled in the art it only makes sense to discuss frequency resolution in terms of number of frequency channels under the assumption that the frequency range covered by the frequency channels is constant. Ultimately, the frequency resolution is only determined by the length in time of the analysis window. A typical choice of analysis window will be 20 milliseconds and at least the length of analysis window will be in the range between 1 millisecond and 60 milliseconds.

The various embodiments according to FIG. 4 are furthermore considered advantageous with respect to both battery consumption and required wireless bandwidth compared to the prior art of hearing aid systems having distributed processing because only the filter coefficients for the time-varying filter 404 need to be transmitted back to the hearing aid 412 from the external device 413.

In a further advantageous variation the wireless bandwidth required to transmit data from the hearing aid 412 and to the external device 413 is approximately the same bandwidth that is required for transmitting data the other way, which simplifies the implementation of the wireless transmission. According to a variation the data payload required to transmit a power spectrum is a factor of at least three larger than the data payload required to transmit a set of filter coefficients for the time-varying filter 404 but on the other hand the power spectrum only needs to be transmitted at least one third as often as the set of filter coefficients. According to a specific variation the power spectrum is calculated every say 200 milliseconds and comprises 512 frequency channels, which are represented by 16 bit, and consequently resulting in a required bandwidth of 41 kbps, whereas the say 64 filter coefficients, which also are represented by 16 bit needs to be updated every say 20 milliseconds and consequently resulting in a required bandwidth of 51 kbps. Furthermore it may be noted that wireless transmission of a digital input signal for a hearing aid system typically will require a larger bandwidth.

In a variation the time-varying filter calculator 411 is adapted to determine filter coefficients that provide a time-varying filter 404 that is minimum phase.

In a variation the frequency dependent target amplitude response may be determined in order to both suppress noise and alleviate a hearing deficit of an individual wearing the hearing aid system. Or in another variation the frequency dependent target amplitude response may be determined in order to only suppress noise.

In one variation of the FIG. 4 embodiments the deconvolution filter may be omitted.

In another variation the signal filtered in the deconvolution filter 403 is provided to the analysis filter bank instead of the digital input signal from the ADC 402, whereby the complexity of the gain calculation may be reduced.

In an embodiment, the time-varying filter 404 is configured to converge against a pre-determined setting in response to a loss of wireless transmission between the hearing aid 412 and the external device 413. In a further variation the predetermined setting of the time-varying filter provides an amplitude response that is the opposite of the hearing loss of the individual wearing the hearing aid system. In a further variation a broadband compressor, corresponding to the MPO controller 307 and gain multiplier 308 disclosed with reference to FIG. 3 is additionally activated in response to the loss of wireless transmission.

Figure 5:
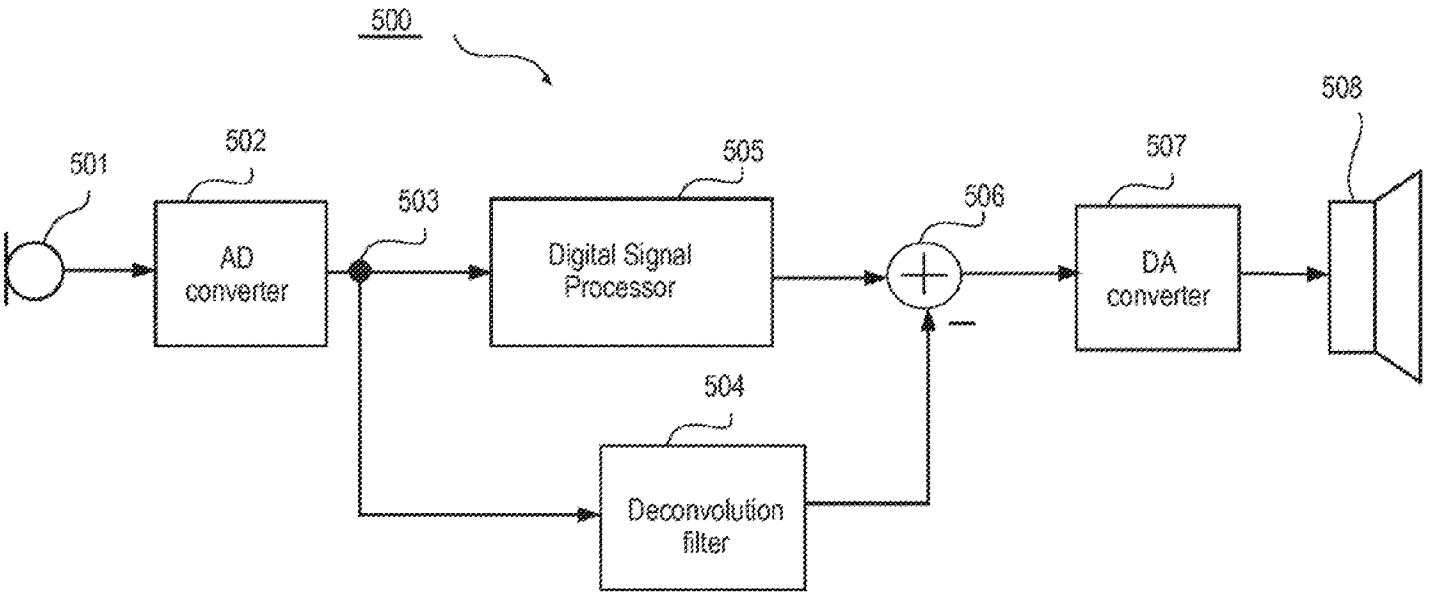
FIG. 5 illustrates highly schematically a hearing aid system according to an embodiment of the invention.

Reference is now made to FIG. 5, which illustrates highly schematically a hearing aid system 500 according to an embodiment of the invention.

The hearing aid system 500 comprises an acoustical-electrical input transducer 501, i.e. a microphone, an analog-digital converter (ADC) 502, a signal splitter 503, a deconvolution filter 504, a digital signal processor 505, a signal combiner 506, a digital-analog converter (DAC) 507 and an electro-acoustical output transducer, i.e. the hearing aid speaker 508.

The output from the ADC is provided to the signal splitter 503, whereby two parallel branches are formed, which in the following may be denoted the main signal branch and the active noise cancelling branch respectively. The active noise cancelling branch comprises—in addition to the components that are shared by the two branches, namely the microphone 501, the ADC 502, signal splitter 503, the signal combiner 506, the DAC 507 and the hearing aid speaker 508—the deconvolution filter 504 and is combined with the main signal branch through the signal combiner 506, wherein the signal provided from the deconvolution filter 504 (i.e. from the active noise cancelling branch) is subtracted from the signal from the digital signal processor 505 (i.e. from the main signal branch). The output from the signal combiner 506 is provided to the DAC 507 and then on to the hearing aid speaker 508. The main signal branch further comprises, inserted between the signal splitter 503 and the signal combiner 506 the digital signal processor 505 that is configured to apply a frequency dependent gain (or, using a more general wording, to provide a processed output) that is adapted to at least one of suppressing noise, enhancing a target sound, customizing the sound to a user preference and alleviating a hearing deficit of an individual wearing the hearing aid system.

As discussed with reference to the previous embodiments the deconvolution filter 504 has the effect of reducing the total group delay of a processing path by compensating delay introduced by other components of the processing path. In the present embodiment the deconvolution filter may therefore reduce the group delay introduced by components selected from a group comprising the acoustical-electrical input transducer 501, the analog-digital converter 502, the digital-analog converter 507 and the electrical-acoustical output transducer 508, for at least some frequency components.

The advantage of incorporating the active noise cancelling branch, according to the present invention, in a hearing aid system is that it allows active cancelling of sound that is transmitted past the hearing aid system and directly to the eardrum. In order to achieve effective active noise cancelling the amplitude of the directly transmitted sound needs to be comparable to the amplitude of the sound provided as a result of the processing in the active noise cancelling branch and the phase of the two sound signals must be of approximately opposite sign.

It is a specific advantage of the embodiment according to FIG. 5, that the total group delay reducing effect offered by the deconvolution filter provides flexibility with respect to choice of sample rate for the active noise cancelling branch, because the delay introduced by the change of sample rate may be at least partly compensated. Similarly, the total group delay reducing effect provides flexibility with respect to the choice of ADC and DAC type.

According to a variation of the FIG. 5 embodiment the amplitude response of the deconvolution filter 504 is determined based on a measurement of the direct transmission gain, (i.e. the attenuation of the sound transmitted past the in-the-ear part of the hearing aid system, when travelling from the ambient and to the ear drum). This measurement may be carried out during the initial programming of the hearing aid system, but may also be carried out at a later point in time in order to take various effects such as ageing of the hearing aid system components or repositioning of the in-the-ear part into account. The subsequent measurement may be carried out automatically with regular intervals or be user initiated. The latter option being particularly advantageous at least because it allows a convenient implementation where at least parts of the relative complex processing required to determine the direct transmission gain may be carried out in an external device, such as a smart phone, of the hearing aid system. Thus as will be obvious for a person skilled in the art the amplitude response of the deconvolution filter 504 is determined such that the amplitude response for the whole active noise cancelling branch matches the direct transmission gain.

In a specific variation the processing to be carried out in order to determine the direct transmission gain, may be offered as a software application (a so called app) that is downloadable to the external device or alternatively the functionality of the software application may instead be provided by a web service, that is hosted on an external server that may be accessed using a web browser of the external device.

The direct transmission gain may be determined by initially measuring an in-situ loop gain, subsequently selecting an effective vent parameter based on identification of a simulation model of the hearing aid system, which best approximates the measured in-situ loop gain, and finally determining the direct transmission gain using the simulation model with the selected effective vent parameter.

In an further variation the determined amplitude response of the deconvolution filter 504 takes the vent effect into account wherein the vent effect is defined as the sound pressure at the ear drum that is generated by the electrical-acoustical output transducer 508 in a sealed ear canal relative to the sound pressure at the ear drum that is generated by the electrical-acoustical output transducer 508 accommodated in the in-the-ear part having a given effective vent parameter.

Further details concerning how to determine an effective vent parameter and the related variables such as direct transmission gain and the vent effect may be found in U.S. Pat. No. 8,532,320B1.

In the following the in-the-ear part of the hearing aid system may also be denoted an ear plug.

According to a further variation the amplitude response or the total group delay of the deconvolution filter may be determined based on user interaction.

In yet further variations the active noise cancelling branch comprises a FIR filter in order to allow at least the total group delay and the amplitude response of the branch to be adjusted, in a simple manner, compared to designing the deconvolution filter to provide these adjustments. In a further variation the active noise cancelling branch comprises a broad band gain multiplier in order to allow the amplitude response of the branch to be adjusted, in a simple manner.

Therefore both the FIR filter and the broad band gain multiplier are especially advantageous when used to provide these adjustments in response to a user interaction.

In variations any filter capable of providing a desired amplitude response may be used instead of a FIR filter, such as an IIR filter.

In a variation the user interaction is controlled by an interactive personalization scheme, wherein a user is prompted to select between different settings of e.g. the total group delay and the amplitude response of the active noise cancelling branch, and based on the user responses the interactive personalization scheme finds an optimized setting. Further details on one example of such an interactive personalization scheme may be found e.g. in WO-A1-2016004983.

A method of optimizing settings of the active noise cancelling branch based on user preference through an interactive personalization scheme is particularly attractive because it is difficult to precisely simulate the impact from the active noise cancelling branch when the hearing aid system is worn by a user. Therefore effective active noise cancelling may be achieved even without using an ear canal microphone in order to optimize the settings of the active noise cancelling branch.

In other variations the deconvolution filter or the FIR filter is designed to provide a low pass filter characteristic, because the efficiency of the active noise cancelling may decrease with frequency, due to the higher sensitivity to misadjustments of the desired group delay in order to achieve cancelling and because the noise to be cancelled typically is low frequency noise. According to a more specific variation the deconvolution filter or the FIR filter is designed to provide a low pass filter characteristic with a cut-off frequency in the range between 1 kHz and 2 kHz. A further advantage of this variation is that an improved compromise may be found between the opposing objectives of respectively approximating the amplitude response to the desired target amplitude response and reducing the total group delay as much as possible.

As will be obvious for a person skilled in the art, the term "desired target amplitude response" is construed to reflect the desired target amplitude response for the whole active noise cancelling branch.

Generally, the combination of the deconvolution filter and an additional component such as a FIR filter or a broadband gain multiplier may be denoted a group delay reducing element.

In a variation the active noise cancelling branch is only activated in response to an effective vent size exceeding a threshold, whereby e.g. a hearing aid system capable of adjusting the effective vent size during use may become particularly interesting. However, in an alternative variation the hearing aid system programming software (which may also be denoted fitting software) is configured to only offer the active noise cancelling feature in case the selected vent provides an effective vent size that exceeds a predetermined threshold.

In another variation, the active noise cancelling branch is activated in response to a sound environment classification determining that the noise is primarily in the low frequency range and of a magnitude that makes it impossible to suppress the noise sufficiently even if the low frequency bands are shut down. This may be done simply by investigating if the sound pressure level at a given frequency is above a given threshold.

In further variations of the FIG. 4 embodiments the time-varying filter may be replaced by a network adapted to provide a processed output based on selected values of weights (which may also be denoted coefficients) in the network. The values of the weights are selected based on at least one of:

- a desired frequency dependent gain for the hearing aid, and
- a desired frequency response for the hearing aid, and a signal vector at least derived from an output signal from the acoustical-electrical input transducer 401, and a signal vector at least derived from an input signal to the electrical-acoustical output transducer 406;

More specifically the network may be selected from a group of networks comprising a single digital linear filter, a single digital non-linear filter, a single digital minimum phase filter, a single mixed phase filter, a combination of at least one of serial and parallel coupled digital filters, a neural network and a linear or non-linear combination of a multitude of signal vectors, wherein said signal vectors are at least derived from a group of signals comprising:

an output signal from an acoustical-electrical input transducers, and an input signal to the electrical-acoustical output transducer.

According to variations the signal vectors are derived from said group of signals in so far that said output and input signals have been filtered e.g. by the deconvolution filter described above or by various filter banks or decimation filters.

According to more specific variations the signal vector elements, of said signal vectors, are selected from a group of signal samples comprising time-domain signal samples, time-frequency domain signal samples and other types of transformed signal samples, and wherein said signal samples are derived from said group of signals.

Generally the signal samples of the various domains are provided using a multitude of methods selected from a group comprising frequency domain transforms, based on e.g. a Discrete Fourier Transform (DFT), and Cepstrum transforms.

In the variations where the signal samples are not from the time domain a corresponding transformation block or filter bank is required in the main signal path (which may also be denoted the first branch when referring to the FIG. 4 embodiment) as opposed to e.g. the FIG. 4 embodiment where the analysis filter bank is positioned in the analysis branch (which may also be denoted the second branch when referring to the FIG. 4 embodiment).

In further variations of the FIG. 4 embodiments the at least one of the desired frequency dependent gain or the desired frequency response of the hearing aid is adapted to at least one of suppressing noise, enhancing a target sound, customizing the sound to a user preference and alleviating a hearing deficit of an individual wearing the hearing aid system.

According to more specific variations enhancement of a target sound may be achieved based on various speech enhancing techniques, all of which will be well known for a person skilled in the art. However one specific example of such a speech enhancing technique is disclosed in WO-A1-2012076045.

According to other more specific variations customization of sound to a given user's preference may be achieved based on various interactive personalization techniques, all of which will be well known for a person skilled in the art, and one specific example of such an interactive personalization technique that may be used to customize sound is disclosed in WO-A1-2016004983.

According to another more specific variation suppression of noise is achieved at least partly by suppressing acoustic feedback based on adaptive feedback cancelling methods, all of which will be well known for a person skilled in the art. However, suppression of noise may also be achieved at least partly by applying beam forming methods, all of which will likewise be well known for a person skilled in the art of directional systems.

According to a variation the network is a neural network, which is advantageous at least in being highly flexible with respect to the processed output functions that can be provided.

According to a more specific variation the network consists of a single digital minimum phase filter.

According to another variation the hearing aid comprises a maximum power output controller (MPO) adapted to estimate the sound level to be provided by the hearing aid speaker and based hereon do at least one of applying a negative gain and muting the hearing aid in case this is required in order to avoid at least one of saturation of the digital-analog converter, saturation of the hearing aid speaker and providing a sound pressure level that is damaging for a hearing aid system user. This variation is advantageous in the context of the FIG. 4 embodiment and its variations because it alleviates potentially detrimental effects from errors introduced by distributing to an external device the calculation of the multitude of weights of the hearing aid network adapted to provide a desired processed output.

It is especially advantageous to include a maximum power output controller in embodiments wherein the main signal processing providing the input signal to the output transducer is controlled from an external device and using processing that may be provided by a third party because such embodiments may be less robust with respect to avoiding undesired sound output levels.

According to a more specific variation the input signal to the maximum power output controller is the input signal to the electrical-acoustical output transducer.

According to yet another variation the hearing aid system comprises, in addition to the second digital signal processor accommodated in the external device, a third digital signal processor accommodated in the hearing aid, wherein the hearing aid system is adapted to select the second or the third digital signal processor for calculating the multitude of weights, based on a trigger event from a group of events comprising a user input, a sound classification, a specific location, a communication link quality estimate and a power supply status.

This feature of allowing to select between using either the second or the third DSP for calculating the multitude of network weights is particularly advantageous in case the communication link quality estimate indicates that the weights received by the hearing aid from the external device may be erroneous and that consequently better performance can be achieved by using the third DSP, despite that the weights provided by the third DSP will typically be based on less advanced methods due to the limited processing resources in the hearing aid compared to the external device.

In a similar manner it may be selected to use the third DSP in case the power supply status indicates that the power is running low and that consequently it will be advantageous to shut down the wireless communication link in order to prolong battery life.

Furthermore the third DSP is generally advantageous as a back-up in case the hearing aid system user for some reason is unsatisfied with the quality of the processing provided using the external device and therefore it is additionally advantageous to allow the hearing aid system user to control whether to use the second or the third digital signal processor based on manipulating a user input. This can be done by the hearing aid system user for whatever reason and at any point in time.

According to another variation it may be selected to use the second DSP in case a specific sound environment is detected for which advanced processing, only available from the second DSP, can benefit the hearing aid system user. In this case the second DSP may be selected automatically or the user may be prompted by the external device to optionally enable the advanced processing to be carried out by the second DSP, e.g. as part of an in-app purchase. According to a more specific variation the specific sound environment is automatically detected by the hearing aid system based on identification of a specific location using a geo-positioning system such as the Global Positioning System or alternatively using information provided from a location specific wireless transmitter such as a wireless beacon or a local area network.

According to another variation the external device is configured to prompt the hearing aid system user to optionally select and download a first application to be executed by the second digital signal processor in order to calculate the multitude of weights of the network, wherein the external device is configured to access an internet server comprising a multitude of such first applications, and wherein the prompting is triggered by a trigger event selected from a group of trigger events comprising identification of a specific sound environment, identification of a specific location and a user input.

According to a more specific variation the identification of a specific location by the hearing aid system is provided from a location specific wireless transmitter such as a wireless beacon or a local area network.

In another variation the hearing aid system user has identified a specific application, that may be run on the second digital signal processor, which the user prefers in a specific sound environment that the hearing aid system is capable of identifying and consequently the user may choose to set up the hearing aid system to automatically select that specific application when the specific sound environment is identified.

According to an even more specific variation the configuration of the external device to carry out at least one of prompting a user, accessing a specific server and evaluating the trigger event, is carried out by a second downloaded application.

Hereby a particularly flexible hearing aid system is provided since both the weight calculations to be carried out by the external device and the graphical user interface required to select, download and activate the algorithm (i.e. the first application) for carrying out the weight calculations can be downloaded to the external device. According to a typical embodiment the external device will be a smart phone.

According to a further variation the second digital signal processor is adapted to calculate the multitude of weights of the network by distributing at least some of the calculations to a remote internet server.

According to yet another variation the hearing aid is adapted to evaluate the multitude of weights received from the external device and in response hereto providing a new set of the multitude of weights by extrapolating from received sets of multitude of weights and hereby allowing at least one of increasing the time between data transmissions and handling a situation where a set of multitude of weights is not received as expected. This variation is advantageous in so far that power consumption may be reduced by increasing the time between data transmissions and in that loss of an expected data transmission can be concealed by extrapolating from the most recently received sets of multitude of weights.

According to a more specific variation the evaluation of the multitude of weights transmitted from the external device comprises the step of:

determining if the received multitude of weights are suitable for use based at least partly on input from sensors selected from a group comprising an electro-encephalography monitor, an accelerometer, a global positioning system unit and a wireless interface configured to receive information from at least one of digital broadcast systems and devices operating in accordance with an internet of things network. This variation is advantageous because it enables an additional check of whether the received multitude of weights are suitable for the current situation of the hearing aid system user. As one example the EEG monitor can reveal whether the hearing aid system user is directing his attention to understanding speech, listening to music or sleeping. The accelerometer may reveal whether the user is sleeping or at least lying down and probably relaxing or is moving around and engaged in some physical activity.

Thus if the received multitude of weights appears not to be optimal for the situation indicated by the other sensors then the hearing aid may select to automatically switch to an alternative processing available in the hearing aid or may prompt the user to consider switching to another application for calculating the multitude of weights.

According to a variation the second digital signal processor is adapted to selectively control the configuration of the network.

This variation is advantageous in providing a hearing aid system with optimized performance because the network configuration can selectively be adapted to best suit at least one of the current sound environment, the preferences or hearing loss of the individual hearing aid system user and a downloadable algorithm.

As one example directional systems may be advantageous in some sound environments and not in others and as a consequence hereof the transmission of weights to the part of the network providing the directional system is no longer required and this is handled by re-configuring the network to leave out that part of the network. The same is true for feedback cancelling systems, which as one example may be de-activated if music is detected.

It is noted that in context of the present invention the terms digital signal processor and downloadable application may be used interchangeably because the downloadable application is run by the digital signal processor, wherefrom it follows that if the digital signal processor is adapted to exhibit specific characteristics then these characteristics may originate from the application that is run by the digital signal processor.

According to a more specific variation the network comprises a single digital filter and the second digital signal processor is adapted to selectively control the configuration of the network by synthesizing the single digital filter to represent a specific combination, out of a multitude of combinations, of at least one of serial and parallel coupled digital filters, wherein the coupled digital filters are selected from a group comprising linear phase digital filters, minimum phase digital filters and mixed phase digital filters, each of the coupled digital filters being adapted to provide a frequency response determined in order to provide the processed output when the coupled digital filters are coupled in accordance with the specific combination.

This is advantageous in that a highly flexible hearing aid system can be implemented in a very simple manner because a single digital filter, through the synthetization (i.e. the choice of filter coefficients) can be adapted to represent a huge variety of coupled digital filters of various types. Thus instead of replacing the single digital filter with such a combination of digital filters, then the single digital filter is synthesized to represent the specific combination. This is further described with reference to the FIG. 8 embodiment and its variants.

According to a further variations the hearing aid system is adapted to change the specific combination that the single digital filter represents based on at least one of the current sound environment or in response to a user interaction.

According to other variations not just a single but several digital filters are synthesized to represent a specific combination, out of a multitude of combinations, of at least one of serial and parallel coupled digital filters. This is further described below with reference to e.g. the FIGS. 6-7 and FIG. 10 embodiments and their variations.

Typically a Finite Impulse Response (FIR) filter is selected for the single digital filter but in variations an Infinite Impulse Response (IIR) filter may be selected.

According to another aspect of the present invention an internet server is provided that comprises a multitude of downloadable applications that may be executed by a personal communication device (such as the external device of the hearing aid systems of the present invention), wherein the multitude of downloadable applications are adapted to calculate a multitude of weights for a network that is configured to provide a processed output that is adapted to at least one of suppressing noise, enhancing a target sound, customizing the sound to a user preference and alleviating a hearing deficit of an individual wearing the hearing aid system, wherein the internet server is adapted to request information from the personal communication device in order to determine whether a downloadable application is compatible with a given hearing aid associated with the personal communication device and in response hereto selectively allowing the application to be downloaded by the personal communication device, and wherein the internet server is adapted to receive information from the personal communication device in order to determine the type and characteristics of a trigger event that caused the personal communication device to access the internet server and in response hereto selectively offer at least one application to be downloaded by the personal communication device, wherein the trigger event type is part of a group of trigger events comprising identification of a specific sound environment, identification of a specific location and a user input and wherein the internet server is maintained by a manufacturer of hearing aid systems.

According to another aspect of the present invention a method of operating a hearing aid system comprising a hearing aid, an external device and a communication link adapted to transmit data between the hearing aid and the external device, wherein the method comprises the steps of:

transmitting first data from the hearing aid and to the external device and in response hereto transmitting second data from the external device and to the hearing aid, wherein the first data comprises at least one of a desired frequency dependent gain for the hearing aid, and a desired transfer function for the hearing aid, and a signal vector at least derived from an output signal from the acoustical-electrical input transducer, and a signal vector at least derived from an input signal to the electrical-acoustical output transducer and wherein the second data comprises a multitude of weights for a network, in the hearing aid, that is configured to provide a processed output that is adapted to at least one of suppressing noise, enhancing a target sound, customizing the sound to a user preference and alleviating a hearing deficit of an individual wearing the hearing aid system, and using a first digital signal processor in the hearing aid in order to provide the processed output using the network and the received second data and using a second digital signal processor in the external device to calculate the multitude of weights of the network based on the received first data.

Figure 6:
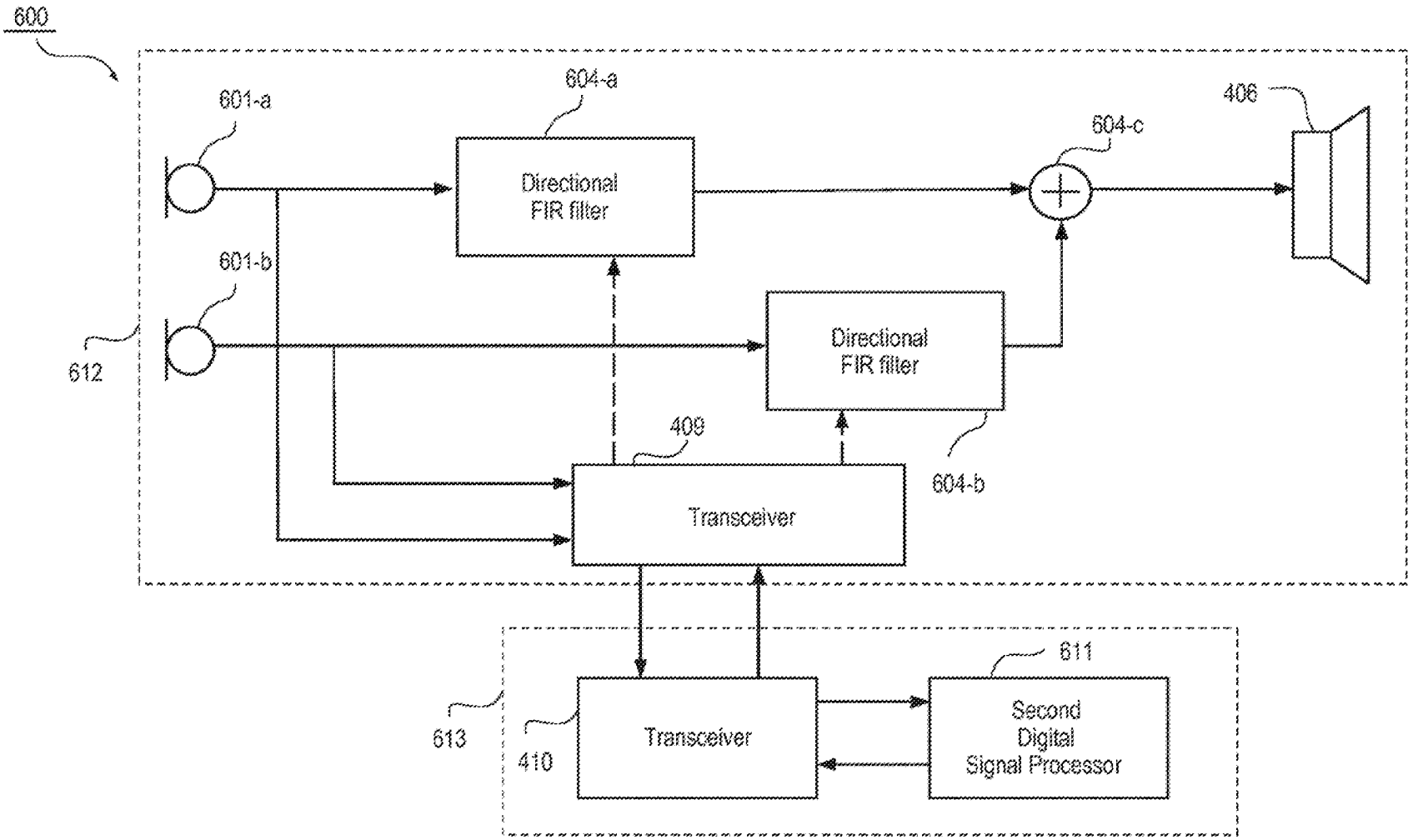
FIG. 6 illustrates highly schematically a hearing aid system according to an embodiment of the invention.

Reference is now made to FIG. 6, which illustrates highly schematically a hearing aid system 600 according to an embodiment of the invention. The hearing aid system 600 comprises many of the same components as the hearing aid system 400 according to the FIG. 4 embodiment, except in that the deconvolution filter 403 is omitted (although in variations it may be included), in that two acoustical-electrical input transducers 601-*a* and 601-*b* are included in the hearing aid system 600, in that the time-varying filter 404 is replaced by two serially connected digital Finite Impulse Response (FIR) filters 604-*a* and 604-*b* (which in the following may be denoted Directional FIR filters to emphasize a typical functionality) that have their output signals combined in the signal combiner 604-*c* whereby a linear combination of two input signal vectors in the time domain is provided.

Furthermore the hearing aid system 600 distinguishes the hearing aid system 400 in that the analysis filter bank 407 and the gain calculator 408 are omitted and the input signal vectors (comprising subsequent input signal samples) are provided directly to the hearing aid transceiver 409 and here from wirelessly transmitted to the external device 613 comprising a second digital signal processor 611 adapted to determine a desired frequency response, based on the received input signal vectors (i.e. the signal vectors comprising samples of the output signals from the acoustical-electrical input transducers 601-*a* and 601-*b*) and adapted to calculate weights for the two FIR filters 604-*a* and 604-*b* such that the desired frequency response is achieved. The ADCs are omitted from FIG. 6 for reasons of clarity and the weights provided to the FIR filters 604-*a* and 604-*b* are indicated with stipulated lines in order to improve figure clarity by distinguishing between these control signals and the signals that represent the input to and output from the FIR filters 604-*a* and 604-*b*.

In a variation further signal processing is carried out on the signal output from the signal combiner 604-*c*, whereby e.g. the hearing deficit of an individual wearing the hearing aid system may be alleviated by applying a frequency dependent gain reflecting the hearing loss of the individual. In a more specific variation the further signal processing is carried out based on the input signal vectors. Such a variation is further described in the FIG. 10 embodiment.

In other variations the input signals are split into frequency sub-bands either in the hearing aid 612 before the signal vectors are provided to the transceiver 409 or alternatively this is done by the second digital signal processor 611 in the external device 613. In more specific variations the split into frequency sub-bands is carried out using e.g. frequency domain methods such as the Fast Fourier Transform, but the split may likewise be carried out in the time domain using a multitude of band pass filters.

In yet another variation the input signals are processed in a spatial filter whereby signal vectors comprising spatially filtered input signal samples are provided to the transceiver 409. Signal vectors comprising spatially filtered input signal samples are therefore one example of signal vectors that are derived from an acoustical-electrical input transducer (i.e. microphone).

In a more specific variation the spatial filter provides a sum and a difference signal as the spatially filtered input signals.

Figure 9:
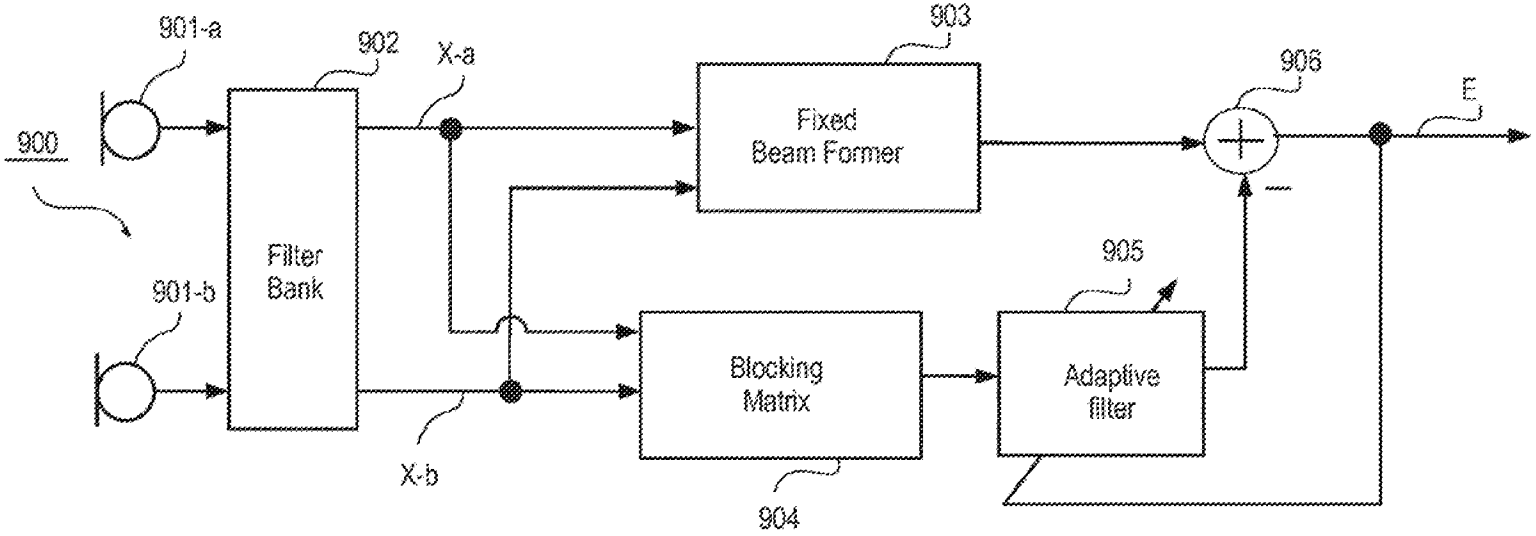
FIG. 9 illustrates highly schematically a directional system suitable for implementation in a hearing aid system according to an embodiment of the invention.

Reference is now made to FIG. 9, which illustrates highly schematically a directional system 900 suitable for implementation in a hearing aid system according to e.g. the FIG. 6 embodiment of the invention.

The directional system 900 takes as input, the digital output signals, at least, derived from the two acoustical-electrical input transducers 901-*a* and 901-*b*.

According to the embodiment of FIG. 9, the acoustical-electrical input transducers 101*a*-*b*, which in the following may also be denoted microphones, provide analog output signals that are converted into digital output signals by analog-digital converters (ADCs) and subsequently provided to a frequency band filter bank 902 adapted to transform the digital output signals into a multitude of frequency band signals, wherein the frequency band signals from the first microphone 101-*a* and the second microphone 101-*b* in the following may be denoted $X_a$ and $X_b$ respectively.

However, for reasons of clarity the ADCs are not illustrated in FIG. 9. Furthermore, in the following, the frequency band signals from the frequency band filter bank 902 will primarily be denoted input signals because these signals represent the primary input signals to the directional system 900. Additionally the term digital input signal may be used interchangeably with the term input signal. In a similar manner all other signals referred to in the present disclosure may or may not be specifically denoted as digital signals. Finally, at least the terms input signal, digital input signal, frequency band input signal, sub-band signal and frequency band signal may be used interchangeably in the following and unless otherwise noted the input signals can generally be assumed to be frequency band signals independent on whether the filter bank 102 provide frequency band signals in the time domain or in the time-frequency domain. Furthermore, it is generally assumed, here and in the following, that the microphones 101*a*-*b* are omni-directional unless otherwise mentioned.

According to an embodiment the filter bank 902 comprises a multitude of time-domain bandpass filters, such as Finite Impulse Response bandpass filters in order to provide the frequency band signals.

The frequency band signals from both microphones 901-*a* and 901-*b* are branched, whereby the frequency band signals, in a first branch, is provided to a Fixed Beam Former (FBF) unit 903, and, in a second branch, is provided to a blocking matrix 904 the output signals from which are subsequently filtered by the adaptive filter 905 and the resulting filtered frequency band signals are next subtracted, using the subtraction unit 906, from the omni-signal provided in the first branch in order to remove the noise, and the resulting output signal from the subtraction unit 906 constitutes the beam formed signal that is provided to further processing in the hearing aid system while at the same time also being fed back to the adaptive filter 905 as control signal and wherein the further processing may comprise suppressing noise, enhancing a target sound, customizing the sound to a user preference and alleviating a hearing deficit of an individual wearing the hearing aid system with the directional system implemented.

The resulting beam formed signal E may therefore be expressed using the equation:

$$E=X_a(1+K_{BM}K_{AdaptFilter})+X_b(1-K_{BM}K_{AdaptFilter})$$

Wherein $K_{BM}$ represents the frequency response of the blocking matrix 904 and $K_{AdaptFilter}$ represents the frequency response of the adaptive filter 905.

The directional system 900 is of the Generalized Sidelobe Canceller (GSC) type and it follows directly that such a system can be implemented using the system of FIG. 6. However, in variations other types of directional systems such as a multi-channel Wiener filter, a Minimum Mean Squared Error (MMSE) system and a Linearly Constrained Minimum Variance (LCMV) system can be implemented using the system of FIG. 6.

According to variations of the FIG. 9 embodiments the filter bank 902 may be omitted and a broad band directional system implemented.

In general, for directional systems that include a filter bank such as the filter bank 902, an implementation corresponding to FIG. 6 can be realized by synthesizing the FIR filters 604-*a* and 604-*b* to represent frequency dependent processing of the frequency band signals. This will be further explained in the following with reference to FIG. 8, its variations and the corresponding description. The general principle being that a FIR filter is synthesized to represent a specific combination of parallel and serial coupled filters, wherein each (parallel) branch comprises a serial coupling of at least two filters, wherein the first filter (in each branch) represents a bandpass filter providing a frequency band signal and the at least second filter represents the desired processing of the frequency band signal.

Figure 7:
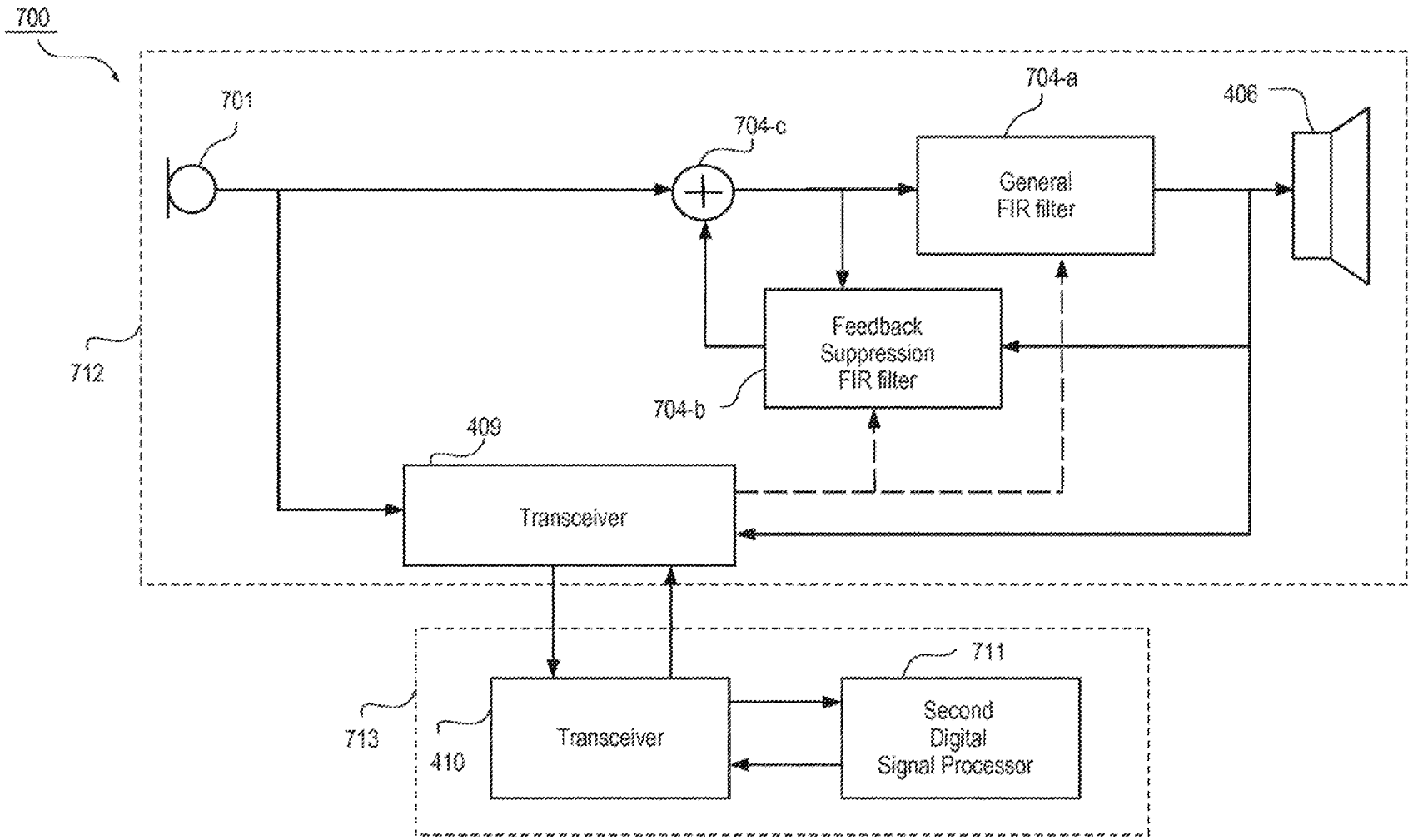
FIG. 7 illustrates highly schematically a hearing aid system according to an embodiment of the invention.

Reference is now made to FIG. 7, which illustrates highly schematically a hearing aid system 700 according to an embodiment of the invention. The hearing aid system 700 comprises many of the same components as the hearing aid system 600 of the FIG. 6 embodiment, except, at least, in that only one acoustical-electrical input transducer 704-*a*, for reasons of figure clarity, is illustrated and in that the two directional FIR filters 604-*a* and 604-*b* are replaced by a general FIR filter 704-*a* that is adapted to provide at least one of suppressing noise, enhancing a target sound, customizing the sound to a user preference and alleviating a hearing deficit of an individual wearing the hearing aid system 700, and replaced by a feedback suppression FIR filter 704-*b*, wherein two input signals are provided to the feedback FIR filter 704-*b* from the input of the general FIR filter 704-*a* and from the input to the electrical-acoustical output transducer 406 respectively, and wherein the input to the general FIR filter 704-*a* is provided from the signal combiner 704-*a* that subtracts the output signal of the feedback suppression FIR filter from an output signal at least derived from the acoustical-electrical input transducer 701.

Hereby is provided a hearing aid system 700, wherein an adaptive feedback canceller can be implemented in the hearing aid 712 and controlled from the external device 713 and wherein only weights for the feedback suppression and general FIR filters 704-*a* and 704-*b* need to be transmitted from the external device 713 and to the hearing aid 712.

Figure 10:
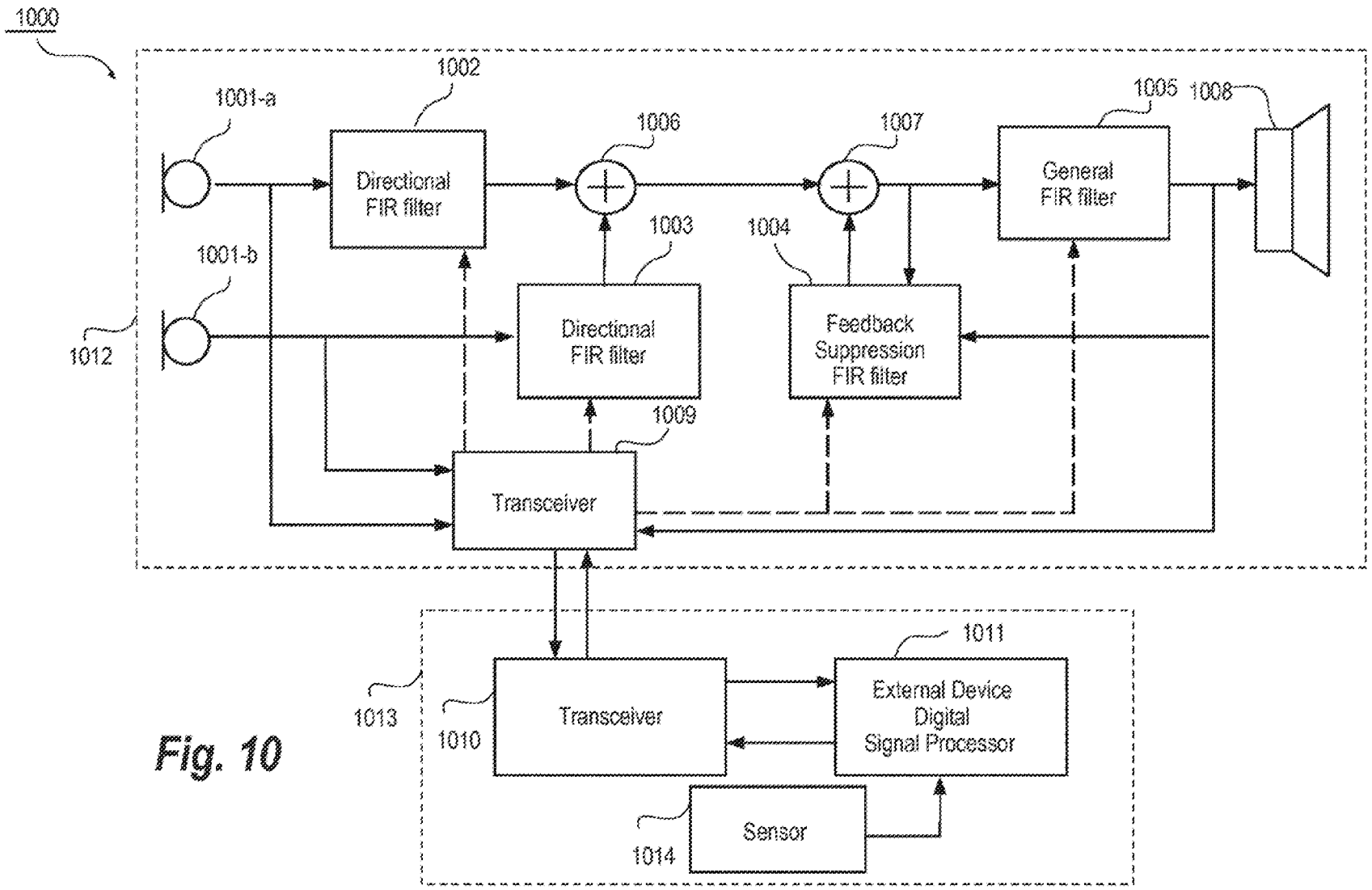
FIG. 10 illustrates highly schematically a highly generic hearing aid system according to an embodiment of the invention.

Reference is now made to FIG. 10, which illustrates highly schematically a hearing aid system 1000 according to an embodiment of the invention. The hearing aid system 1000 comprises a hearing aid 1012 and an external device 1013. The hearing aid 1012 comprises at least two acoustical-electrical input transducers 1001-*a* and 1001-*b*, an electrical-acoustical output transducer 1008, two directional FIR filters 1002 and 1003, a feedback suppression FIR filter 1004 and a general FIR filter 1005, a first and a second signal combiner 1006 and 1007, and a hearing aid transceiver 1009. The external device 1013 comprises an external device transceiver 1010, an external device digital signal processor 1011 (corresponding e.g. to the second digital signal processor of the FIG. 6 embodiment and the time-varying filter calculator of the FIG. 4 embodiment) and an (external device) sensor 1014.

The hearing aid system 1000 is a highly generic system in so far that it combines a directional system, in the form of the two directional FIR filters 1002 and 1003 and the first signal combiner 1006, a general hearing aid processing, in the form of the general FIR filter 105, and a feedback suppression system, in the form of the feedback suppression FIR filter 1005 and the second signal combiner 1007.

The external device sensor 1014 is adapted to provide additional information to the external device digital signal processor 1011 in order to improve performance of the hearing aid system 1000. According to the present embodiment the external device sensor is an acoustical-electrical input transducer (i.e. a microphone) that can provide valuable information to the feedback suppression system because a microphone in the external device typically will experience little or no acoustical feedback because of the larger distance to the electrical-acoustical output transducer 1008 whereby the feedback system can provide improved performance in the form of fewer sound artefacts, that may arise as a consequence of the hearing aid system not being able to distinguish between acoustical feedback and a naturally occurring tonal input (such as music).

It is noted that a positive synergistic effect is provided by accommodating both the additional microphone 1014 (or any other sensor type providing input to the external device signal processor 1011) and the external device signal processor 1011 in the external device 1013 whereby the amount of data to be transmitted between the hearing aid and the external device can be kept at a minimum.

In variations the type of sensor may be selected from a group comprising an electroencephalography (EEG) monitor, an accelerometer, a global positioning system (GPS) unit, and a wireless interface configured to receive information from at least one of digital broadcast systems and devices operating in accordance with an internet of things network.

It is noted that a further positive synergistic effect is provided by using a sensor type that is already part of the external device 1013 because the information from the sensor 1013 does not need to be transmitted to the hearing aid 1012, instead the information is provided to the external device and incorporated in the filter coefficients that are determined by the external device digital signal processor 1011 and transmitted to the hearing aid 1012 anyway, whereby the amount of data to be transmitted between the hearing aid and the external device can be kept at a minimum. Examples of such sensor types are in fact all of the above mentioned i.e. an EEG monitor, an accelerometer, a GPS unit and a wireless interface configured to receive information from e.g. digital broadcast systems and devices operating in accordance with an IoT network. The IoT network topology may be selected from a group comprising mesh, star and point-to-point and the current technologies supporting this type of networks include WiFi, Bluetooth, Zigbee, Z-wave and EnOcean.

In yet other variations the external device 1013 may comprise more than one sensor.

According to another variation the single feedback suppression FIR filter 1004 and the second signal combiner 1007 is replaced by two sets of feedback suppression FIR filters 1004 and signal combiners, wherein the two sets are relocated such that the feedback suppression signal is subtracted from the output signals from the two microphones 1001-*a* and 1001-*b* as opposed to being subtracted from the output signal from the first signal combiner 1006. The advantage hereof being that the feedback suppression is less dependent on the directional system.

Figure 8:
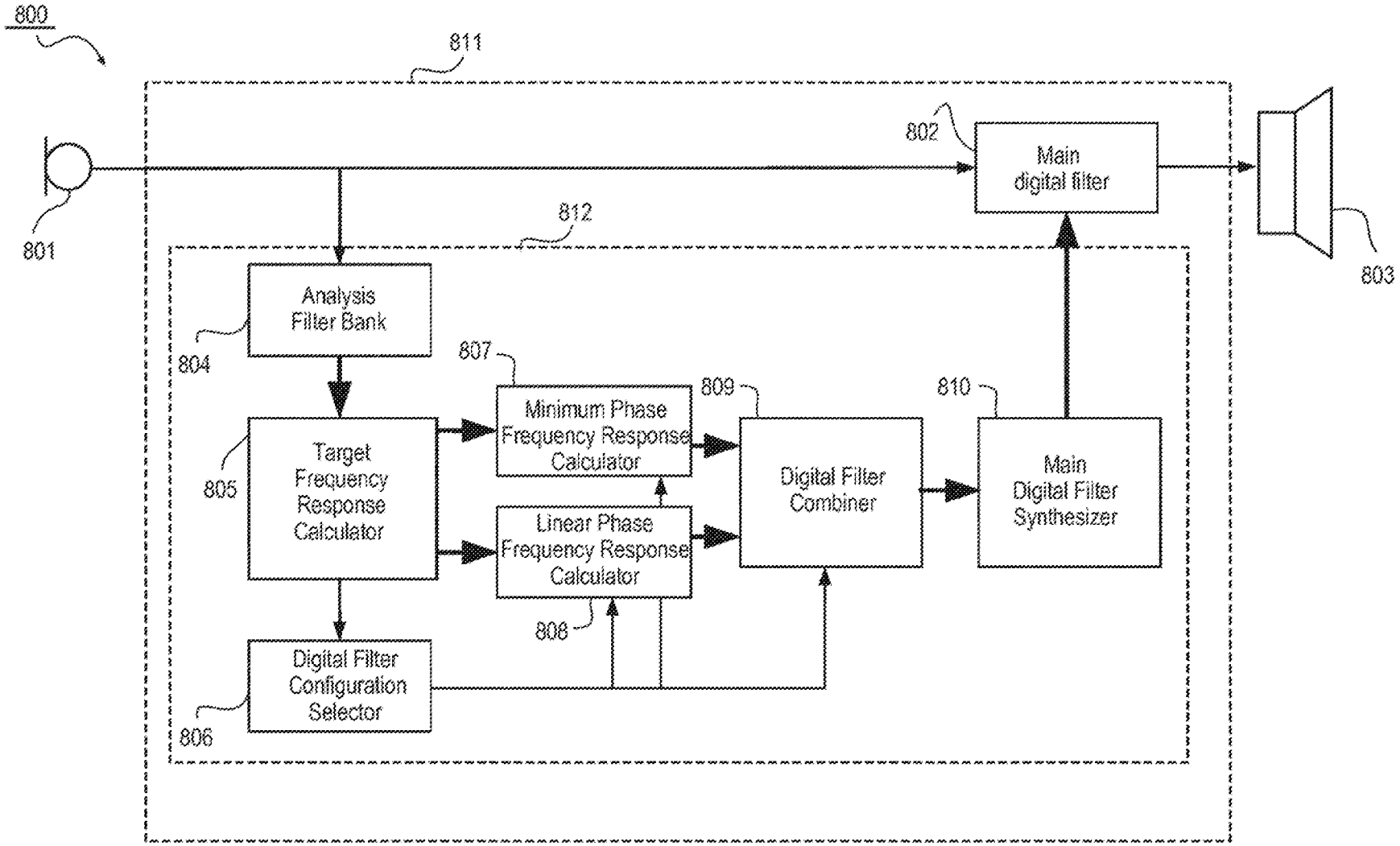
FIG. 8 illustrates highly schematically a hearing aid with features suitable for implementation in a hearing aid system according to an embodiment of the invention.

Reference is now made to FIG. 8, which illustrates highly schematically a hearing aid 800 adapted to be highly flexible and with features suitable for implementation in a hearing aid system according to an embodiment of the invention. The hearing aid 800 comprises an acoustical-electrical input transducer 801, a first digital signal processor 811 and an electrical-acoustical output transducer 803.

The first digital signal processor 811 comprises a main digital filter 802 that is adapted to selectively represent a specific combination, out of a multitude of combinations, of at least one of serial and parallel coupled virtual digital filters, wherein the coupled virtual digital filters are selected from a group comprising linear phase digital filters, minimum phase digital filters and mixed phase digital filters, each of the coupled virtual digital filters being adapted to provide a frequency response determined in order to provide a desired processed output when the coupled virtual digital filters are coupled in accordance with the specific combination. The main digital filter 802 is configured to provide, based on a multitude of weights (i.e. filter coefficients), the desired processed output that is adapted to at least one of suppressing noise, enhancing a target sound, customizing the sound to a user preference and alleviating a hearing deficit of an individual wearing the hearing aid.

According to the present embodiment the first digital signal processor 811 further comprises a main digital filter synthesizing block 812 that comprises

- an analysis filter bank 804 providing a multitude of frequency bands based on a signal at least derived from the output of the acoustical-electrical input transducer 801, and
- a target frequency response calculator 805 adapted to determine a target frequency response to be applied by the first digital signal processor 811 in order to provide the desired processed output, and
- a digital filter configuration selector 806 adapted to determine the specific combination of coupled virtual digital filters based on the target frequency response, and
- two digital filter frequency response calculators, respectively a minimum phase frequency response calculator 807 and a linear phase frequency response calculator 808 each adapted to provide a frequency response of the given digital filter type, wherein the digital filter type is comprised in the specific combination of coupled virtual digital filters, and wherein the provided frequency response is based on the target frequency response, and
- a digital filter combiner 809 adapted to provide a calculated frequency response for the main digital filter 802 by combining a multitude of provided frequency responses of the coupled virtual digital filters in the specific combination, and
- a main digital filter synthesizer 809 adapted to provide the weights for the main digital filter 802.

More generally the two digital filter frequency response calculators 807 and 808 are selected from a group of filter types comprising minimum phase, linear phase and mixed phase.

According to the present embodiment the two digital filter frequency response calculators (807, 808) are adapted to provide a frequency response for a virtual digital filter of the types minimum phase and linear phase respectively. However, in variations at least one of the at least two digital filter types is replaced by a mixed phase digital filter type.

In a further, less advantageous variation, only a single digital filter frequency response calculator, instead of at least two, is provided. This may be realized by adapting the digital filter combiner to temporarily store at least some of the values representing the multitude of provided frequency responses of the coupled virtual digital filters before combining the values.

In variations the target frequency response calculator 805 is not adapted to determine the complete complex target frequency response including both the amplitude and the phase, instead only the frequency response amplitude or phase is determined.

Within the present context the term "target frequency response" is construed to include other specifications of the desired processed output to be provided by the first digital signal processor 811 such as the filter transfer function (although this terminology typically implies that the function is defined in the z-domain). In a specific variation the output from the target frequency response calculator 805 is a target frequency dependent gain.

According to the present embodiment the target frequency response is determined based on the provided multitude of frequency bands at least derived from the output of the acoustical-electrical input transducer 801. However, the target frequency response may be derived using a number of different approaches, all of which will be well known for a person skilled in the art of hearing aids.

According to a specific variation the digital filter configuration selector 806 is adapted to distribute a frequency dependent target gain on a serially coupled virtual digital linear filter and virtual digital minimum phase filter. This configuration is advantageous in case the target frequency response (i.e. in this case the frequency dependent target gain) and hereby also the resulting group delay, exhibits too strong gain variations as a function of frequency because such a situation will introduce undesirable sound artefacts and perceptual distortions if implemented using only a minimum phase filter. However, if some of the determined frequency dependent target gain is provided by a virtual linear phase filter serially coupled with the virtual minimum phase filter, then the resulting group delay can be kept within acceptable limits, while still achieving the benefits of a relatively low group delay.

It is noted that the present invention is particularly advantageous in providing a hearing aid capable of switching, in real time and dependent on the e.g. at least one of the given sound environment, vent estimate (e.g. through control of an adjustable vent), feedback estimate and user preference, between a pure minimum phase implementation and a mixed phase implementation provided by selectively distributing the frequency dependent gain partly on a virtual linear phase filter and partly on a virtual minimum phase filter comprised in the selected specific combination of coupled virtual digital filters, which is represented by the main digital filter. According to an embodiment the switching is carried out by the digital filter configuration selector 806.

It is particularly advantageous to switch between a pure minimum phase implementation and the mixed phase implementations when having an adjustable vent because minimum phase is particular attractive for large vent hearing aids because of the reduced comb filter effect and the reduced likelihood of acoustical feedback that is provided by a minimum phase hearing aid.

According to another variation, the relative distribution of the determined frequency dependent target gain between the coupled digital filters for one hearing aid of a binaural hearing aid system is determined based on the determined frequency dependent target gain for the other hearing aid of the binaural hearing aid system, in order to ensure that a similar group delay is provided by both hearing aids of the binaural hearing aid system. Hereby, even hearing aid system users with an asymmetrical hearing loss will not experience distortions of the inter-aural time difference (ITD), which may result from an excessive group delay difference between the two hearing aids. Distortions of the ITD may be detrimental for the ability to localize sounds and hereby the ability to understand speech especially in multi-speaker situations. It is primarily in the frequency range below 1.5 kHz that the ITD provides important localization cues.

As already disclosed with reference to a variation of the FIG. 9 embodiment a filter bank can be realized by synthesizing a FIR filter to represent a specific combination of parallel and serial coupled virtual digital filters, wherein each (parallel) branch comprises a serial coupling of at least two virtual digital filters, wherein the first virtual digital filter (in each branch) represents a bandpass filter providing a frequency band signal and the at least second filter represents the desired processing of the frequency band signal. According to a specifically advantageous variation the frequency response of the filters, that in each parallel branch represents the bandpass filtering (which in the following may be denoted bandpass filters), is stored in a memory of the hearing aid, whereby the calculation of the bandpass filter frequency responses need not be repeated unnecessarily because the bandpass filters are typically static and as such independent on e.g. the current sound environment. This is especially advantageous in case the bandpass filters, for a filter bank, are synthesized to be of minimum phase because this may require significant processing resources.

According to a further variation the FIG. 5 embodiment can be realized by synthesizing a FIR filter to represent the two parallel coupled filters representing respectively the deconvolution filter 504 and a FIR filter adapted to carry out the processing of the Digital Signal Processor 505. In a more specific variation the frequency response of the deconvolution filter 504 is stored in a memory of the hearing aid, whereby the calculation of deconvolution filter frequency responses need not be repeated unnecessarily because it is typically static and as such independent on e.g. the current sound environment.

According to a similar variation the FIG. 3 embodiment can be realized by synthesizing a FIR filter to represent the two parallel coupled filters representing respectively the fixed FIR filter 304 and a FIR filter adapted to carry out the processing of the MPO Controller 307.

According to another more specific variation the multitude of frequency responses required for implementing the filter bank in a hearing aid is provided from an external device, such as a smart phone, under the control of a third party app. Hereby an added flexibility of the variety of third party algorithms that can be implemented in a hearing aid according to the present invention is provided in that the choice of filter bank characteristics can be controlled by the third party algorithm.

Furthermore it may be attractive to adaptively control, in real-time whether a linear or minimum phase characteristic is desired and hereby the delay. As one example low-delay performance (implying minimum phase filtering) is generally considered advantageous, unless linear phase is required, which e.g. is the case for beam forming or to preserve the inter-aural time difference (ITD). As a more specific example it may be attractive to only provide linear phase in a low frequency range (in order to preserve the ITD and hereby a localization cue), while the high frequency range is processed with a minimum phase characteristic.

More specifically, the digital filter combiner 809 provides the calculated frequency response for the main digital filter 802 by multiplying the frequency responses of serially combined virtual digital filters together and hereby providing at least one first combined frequency response and by summing said at least one first combined frequency response and hereby providing the calculated target frequency response of the main digital filter 802 for the determined specific combination of parallel and serially combined virtual digital filters.

More specifically the main digital filter synthesizer (810) is adapted to provide the weights (i.e. filter coefficients) for the main digital filter (802) in accordance with the calculated target frequency response using any of the well-known methods for digital filter synthetization.

In a variation the provided filter synthetization may include interpolation in order to adapt the resolution of the calculated target frequency response to the number of filter coefficients available in the main digital filter (802), whereby the resulting frequency resolution may be improved.

In another variation the main digital filter synthesizer is adapted to add an additional layer of sound artefact reduction by smoothing the calculated target frequency response.

In further variations the systems and underlying methods of the FIG. 8 embodiment and it variations may be implemented for any and at least one of the digital filters disclosed in the other disclosed embodiments, i.e. e.g. the directional FIR filters 604-*a*, 604-*b*, 1002 and 1003, the feedback suppression FIR filters 704-*b* and 1004, the general FIR filters 704-*a* and 1005, and the time-varying filter 404 of the FIG. 4 embodiments. Thus the term "main digital filter" of the FIG. 8 embodiment may represent any of the above mentioned digital filters or any of the other digital filters described in the various embodiments and including variations.

In a further variation of the FIG. 8 embodiment and its variations, a hearing aid system comprising a hearing aid and an external device is provided wherein the main digital filter synthesizing block 812 is accommodated in the external device. Hereby a highly flexible hearing aid system may be provided at least in so far that a huge multitude of different serial and parallel coupled virtual digital filter configurations may be realized in a hearing aid that only comprises a wireless interface to an external device, whereby an output signal at least derived from at least one acoustical-electrical input transducer in the hearing aid is transmitted to the external device and filter coefficients for the at least one main digital filter 802 is transmitted from the external device and to the hearing aid.

In another variation the analysis filter bank (804) and the target frequency response calculator (805) is accommodated in the hearing aid instead of in the external device whereby the amount of first data may be reduced because only the target frequency response needs to be transmitted.

It is noted that in variations of the various embodiments of the present invention at least one of the first and second data are transmitted at least once every second or at least once every 200 milliseconds. In other variations the transmissions of the first and second data take place with a repetition speed corresponding to the (input signal) sampling and (processing) update frequencies in contemporary hearing aids. It is a specific advantage of the present invention that the disadvantage, with respect to processing speed, of prior art hearing aid systems having distributed processing may be relieved primarily due to the fact that primarily the weights (or filter coefficient values when the network represents a digital filter) for a hearing aid processing network are transmitted from the external device and to the hearing aid.

It is also noted that in the context of the various embodiments of the present invention the input signals to the network may also be denoted signal vectors, since the signal vector elements are successive samples, in time, of the corresponding signals.

According to a further variation an even higher level of synergy and hearing aid system flexibility is obtainable by allowing the external device application to configure the hearing aid network.

According to a specifically advantageous variation the network is a selected mix of serial and/or parallel coupled linear and/or minimum phase digital filters. Such a network is e.g. advantageous in situations where the desired frequency dependent gain (or more generally the desired frequency response) and hereby also the resulting group delay exhibit too strong variations as a function of frequency because such a situation will introduce undesirable sound artefacts and perceptual distortions.

There is a particular synergy in hearing aid systems that comprise a hearing aid network configured to provide a processed output based on a multitude of weights and wherein the applications to determine the multitude of weights controlling the network may be provided from third party providers because the simple interface, between the application in the external device and the hearing aid processing, that mainly constitutes the transmission of the multitude of weights may be used by a large variety of applications. Thus the applications may provide very different types of processing but still be similar in so far that primarily if not only the network weights are required to make the network operate as desired.

In variations hearing aid system embodiments disclosing only a single acoustical-electrical input transducer can be generalized to comprise two acoustical-electrical input transducers in ways that will be obvious for a person skilled in the art.

It is noted that with respect to combining the various embodiments the various terms such as time-varying filter, main digital filter, and single digital filter may be used interchangeably.

In further variations the methods and selected parts of the hearing aid according to the disclosed embodiments may also be implemented in systems and devices that are not hearing aid systems (i.e. they do not comprise means for compensating a hearing loss), but nevertheless comprise both acoustical-electrical input transducers and electro-acoustical output transducers. Such systems and devices are at present often referred to as hearables. However, a headset is another example of such a system.

In still other variations a non-transitory computer readable medium is provided that carries instructions which, when executed by a computer, cause the methods of the disclosed embodiments to be performed.

Other modifications and variations of the structures and procedures will be evident to those skilled in the art.

The invention claimed is:

1. A hearing aid comprising an acoustical-electrical input transducer, a first digital signal processor and an electrical-acoustical output transducer; wherein the first digital signal processor comprises a main digital filter that is adapted to selectively represent a specific combination, out of a multitude of combinations, of at least one of serial and parallel coupled virtual digital filters, wherein the coupled virtual digital filters are selected from a group comprising linear phase digital filters, minimum phase digital filters and mixed phase digital filters, each of the coupled virtual digital filters being adapted to provide a frequency response determined in order to provide a desired processed output when the coupled virtual digital filters are coupled in accordance with the specific combination, and wherein the main digital filter is configured to provide, based on a multitude of weights, a desired processed output that is adapted to at least one of suppressing noise, enhancing a target sound, customizing the sound to a user preference and alleviating a hearing deficit of an individual wearing the hearing aid; and wherein the first digital signal processor comprises a main digital filter synthesizing block that comprises:

an analysis filter bank providing a multitude of frequency bands based on a signal at least derived from the output of the acoustical-electrical input transducer;

a target frequency response calculator adapted to determine a target frequency response to be applied by the first digital signal processor in order to provide the desired processed output;

a digital filter configuration selector adapted to determine the specific combination of coupled virtual digital filters based on the target frequency response;

at least two digital filter frequency response calculators each adapted to provide a frequency response for a digital filter type selected from a group of filter types comprising minimum phase, linear phase and mixed phase, wherein the digital filter type is comprised in the specific combination of coupled virtual digital filters, wherein the provided frequency response is based on the target frequency response, and wherein the at least two digital filter frequency response calculators are adapted to provide frequency responses for different digital filter types;

a digital filter combiner adapted to provide a calculated frequency response of the main digital filter by combining a multitude of provided frequency responses of the coupled virtual digital filters in the specific combination; and a main digital filter synthesizer adapted to provide the weights for the main digital filter.

2. The hearing aid according to claim 1, wherein the digital filter configuration selector is adapted to distribute at least one of the gain and the phase of the target frequency response between the virtual digital filters of the specific combination of coupled virtual digital filters.

3. The hearing aid according to claim 2, wherein the virtual digital filters of the specific combination of coupled virtual digital filters comprises a serially coupled virtual digital linear filter and virtual digital minimum phase filter, and wherein at least some of the gain of the target frequency response is distributed between the virtual linear phase filter and the virtual minimum phase filter, whereby the resulting group delay can be kept within acceptable limits, while still achieving the benefits of a relatively low group delay.

4. The hearing aid according to claim 1, wherein the digital filter configuration selector is adapted to switch between two specific combinations of at least one of serial and parallel coupled virtual digital filters, wherein the switching is dependent on at least one of a classified sound environment, a vent estimate, a feedback estimate and a user preference.

5. The hearing aid according to claim 1, wherein the hearing aid is part of a binaural hearing aid system and wherein the desired processed output is dependent on the desired processed output from a contra-lateral hearing aid of the binaural hearing aid system, in order to ensure that a similar group delay is provided by both hearing aids of the binaural hearing aid system.

6. The hearing aid according to claim 1, wherein the main digital filter is adapted to represent a combination of parallel and serial coupled virtual digital filters, wherein each parallel branch comprises a serial coupling of at least two filters, wherein the first virtual digital filter in each branch represents a virtual bandpass filter adapted to provide a frequency band signal and wherein the at least second virtual digital filter represents the desired processing of the frequency band signal.

7. The hearing aid according to claim 6, wherein the frequency responses of the first virtual digital filters in each branch are stored in a memory of the hearing aid.

8. The hearing aid according to claim 1, wherein the digital filter configuration selector is configured such that said specific combination that the main digital filter represents is selected in response to a trigger event selected from a group of events comprising a user input, an automatic sound environment classification and a vent estimation.

9. A hearing aid system comprising a hearing aid and an external device wherein the hearing aid comprises:

an acoustical-electrical input transducer, an electrical-acoustical output transducer and a main digital filter that is adapted to selectively represent a specific combination, out of a multitude of combinations, of at least one of serial and parallel coupled virtual digital filters, wherein the coupled virtual digital filters are selected from a group comprising linear phase digital filters, minimum phase digital filters and mixed phase digital filters, each of the coupled virtual digital filters being adapted to provide a frequency response determined in order to provide a desired processed output when the coupled virtual digital filters are coupled in accordance with the specific combination, and wherein the external device comprises:

a main digital filter synthesizing block that comprises:

an analysis filter bank providing a multitude of frequency bands based on a signal at least derived from the output of the acoustical-electrical input transducer;

a target frequency response calculator adapted to determine a target frequency response to be applied by the main digital filter;

a digital filter configuration selector adapted to determine the specific combination of coupled virtual digital filters based on the target frequency response;

at least two digital filter frequency response calculators each adapted to provide a frequency response for a digital filter type selected from a group of filter types comprising minimum phase, linear phase and mixed phase, wherein the digital filter type is comprised in the specific combination of coupled virtual digital filters, wherein the provided frequency response is based on the target frequency response, and wherein the at least two digital filter frequency response calculators are adapted to provide frequency responses for different digital filter types;

a digital filter combiner adapted to provide a calculated frequency response of the main digital filter by combining a multitude of provided frequency responses of the coupled virtual digital filters in the specific combination;

a main digital filter synthesizer adapted to provide the weights for the main digital filter wherein both the hearing aid and the external device comprise a wireless interface; and wherein the hearing aid system is adapted to transmit, from the hearing aid and to the external device, first data at least derived from an output signal from or input signal to at least one transducer in the hearing aid, and adapted to transmit, from the external device and to the hearing aid, the weight for the at least one main digital filter.

10. The hearing aid system according to claim 9, wherein the first data comprises at least one of signal vectors at least derived from the output of the acoustical-electrical input transducer and signal vectors at least derived from the input to the electrical-acoustical output transducer and a target frequency response.

11. A method of operating a hearing aid system comprising the steps of:

providing a target frequency response for a main digital filter adapted for at least one of suppressing noise, enhancing a target sound, customizing the sound to a user preference and alleviating a hearing deficit of an individual wearing the hearing aid system;

adapting the main digital filter to selectively represent a specific combination, out of a multitude of combinations, of at least one of serial and parallel coupled virtual digital filters, wherein the coupled virtual digital filters are selected from a group comprising linear phase digital filters, minimum phase digital filters and mixed phase digital filters, each of the coupled virtual digital filters being adapted to provide a frequency response determined in order to provide the target frequency response when the coupled virtual digital filters are coupled in accordance with the specific combination; and wherein the method comprises the further steps of:

determining the specific combination of coupled virtual digital filters based on the target frequency response for the main digital filter;

providing a calculated frequency response of the main digital filter by combining a multitude of provided frequency responses of the coupled virtual digital filters of at least two types, from the group from which the virtual digital filters are selected, in the specific combination; and using a main digital filter synthesizer to provide the weights for the main digital filter.

12. The method according to claim 11, wherein the step of adapting the main digital filter to selectively represent a specific combination comprises the steps of:

representing a combination of parallel and serial coupled virtual digital filters, wherein each parallel branch comprises a serial coupling of at least two filters, wherein a first virtual digital filter in each branch represents a virtual bandpass filter adapted to provide a frequency band signal and wherein the at least second virtual digital filter represents the desired processing of the frequency band signal.

13. The method according to claim 11, wherein the step of adapting the main digital filter to selectively represent a specific combination comprises the steps of:

selecting the specific combination that the main digital filter represents in response to a trigger event selected from a group of events comprising a user input, an automatic sound environment classification, and a vent estimation.

* * * * *